US005179371A

United States Patent [19]

Yamazaki

[11] Patent Number: 5,179,371

[45] Date of Patent: Jan. 12, 1993

[54] LIQUID CRYSTAL DISPLAY DEVICE FOR REDUCING UNEVENNESS OF DISPLAY

[75] Inventor: Katsunori Yamazaki, Suwa, Japan

[73] Assignee: Seiko Epson Corporation, Tokyo, Japan

[21] Appl. No.: 629,953

[22] Filed: Dec. 19, 1990

Related U.S. Application Data

[63] Continuation-in-part of Ser. No. 232,750, Aug. 15, 1988, and a continuation-in-part of Ser. No. 456,123, Dec. 22, 1989, and a continuation-in-part of Ser. No. 513,338, Apr. 20, 1990, and a continuation-in-part of Ser. No. 597,904, Oct. 12, 1990.

[30] Foreign Application Priority Data

| | | | |
|---|---|---|---|
| Aug. 13, 1987 | [JP] | Japan | 62-202154 |
| Feb. 9, 1988 | [JP] | Japan | 63-27922 |
| Feb. 9, 1988 | [JP] | Japan | 63-27923 |
| Feb. 9, 1988 | [JP] | Japan | 63-27924 |
| Dec. 22, 1988 | [JP] | Japan | 63-324421 |
| Apr. 20, 1989 | [JP] | Japan | 1-100683 |
| Oct. 12, 1989 | [JP] | Japan | 1-265662 |
| Dec. 19, 1989 | [JP] | Japan | 63-329055 |

[51] Int. Cl.[5] ..... G09G 3/36

[52] U.S. Cl. ..... 340/784; 340/805; 359/55

[58] Field of Search ..... 340/784, 765, 805; 359/55

[56] References Cited

U.S. PATENT DOCUMENTS

| | | | |
|---|---|---|---|
| 4,045,791 | 8/1977 | Fukai et al. . | |
| 4,485,380 | 11/1984 | Soneda et al. . | |
| 4,630,122 | 12/1986 | Morokawa . | |
| 4,679,043 | 7/1987 | Morokawa . | |
| 4,702,560 | 10/1987 | Endo et al. . | |
| 4,801,933 | 1/1989 | Yamamoto et al. | 340/784 |
| 4,845,482 | 7/1989 | Howard et al. . | |
| 4,864,290 | 9/1989 | Waters . | |
| 5,010,326 | 4/1991 | Yamazaki et al. | 340/784 |
| 5,012,274 | 4/1991 | Dolgoff . | |
| 5,016,982 | 5/1992 | Fergason et al. | 359/55 |

FOREIGN PATENT DOCUMENTS

| | | |
|---|---|---|
| 175417 | 9/1985 | European Pat. Off. . |
| 162969 | 12/1985 | European Pat. Off. . |
| 0303510 | 2/1989 | European Pat. Off. . |
| 0345399 | 12/1989 | European Pat. Off. . |
| 60-19195 | 1/1985 | Japan . |
| 60-19196 | 1/1985 | Japan . |
| 62-31825 | 2/1987 | Japan . |
| 63-159914 | 2/1988 | Japan . |
| 63-240528 | 10/1988 | Japan . |
| 115821 | 4/1990 | Japan . |

*Primary Examiner*—Jeffery A. Brier
*Attorney, Agent, or Firm*—Blum Kaplan

[57] ABSTRACT

A liquid crystal display device applying a scanning voltage wave to a plurality of scanning electrodes and a signal voltage wave to a plurality of signal electrodes to selectively render visible display elements defined at the intersection of scanning electrodes and signal electrodes, and superimposing a correcting voltage upon at least one of the scanning voltage wave and/or the signal voltage wave in order to eliminate unevenness of display. The correcting voltage to be superimposed upon the signal voltage wave and/or the scanning voltage wave is determined and weighed in accordance with the positions from the end portion of the scanning electrode group applied with the scanning voltage wave and/or the positions from the end portion of the signal electrode applied with the signal voltage waveform, of display elements to be rendered visible.

15 Claims, 19 Drawing Sheets

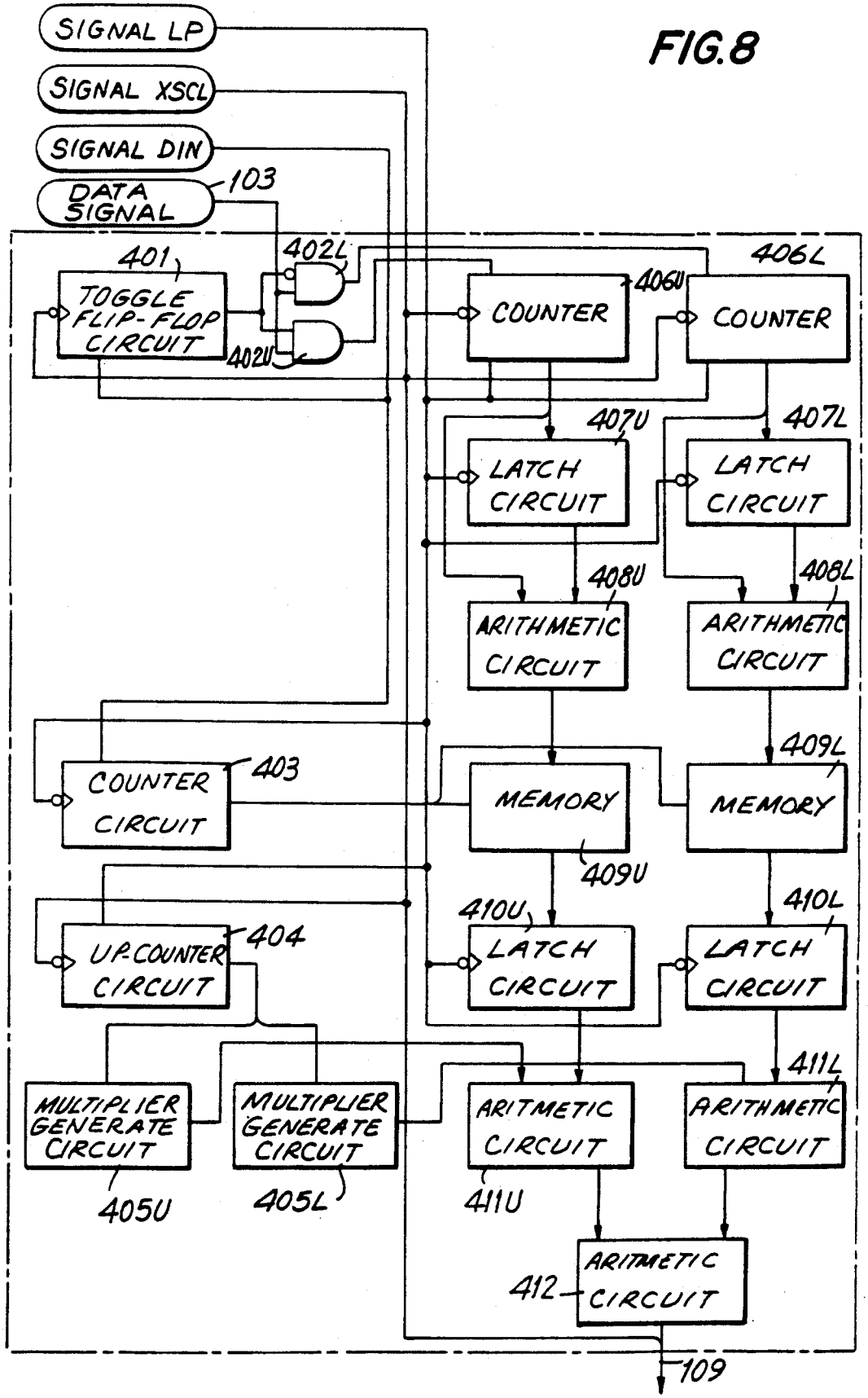
FIG.8
SIGNAL LP
SIGNAL XSCL
SIGNAL DIN
DATA SIGNAL
103
401
TOGGLE FLIP-FLOP CIRCUIT
402L
402U
COUNTER
406U
406L
COUNTER
407U
LATCH CIRCUIT
407L
LATCH CIRCUIT
408U
ARITHMETIC CIRCUIT
408L
ARITHMETIC CIRCUIT
COUNTER CIRCUIT
403
MEMORY
409U
MEMORY
409L
UP-COUNTER CIRCUIT
404
410U
LATCH CIRCUIT
410L
LATCH CIRCUIT
MULTIPLIER GENERATE CIRCUIT
405U
MULTIPLIER GENERATE CIRCUIT
405L
ARITMETIC CIRCUIT
411U
411L
ARITHMETIC CIRCUIT
412
ARITMETIC CIRCUIT
109

LIQUID CRYSTAL DISPLAY DEVICE FOR REDUCING UNEVENNESS OF DISPLAY

CROSS REFERENCE OF RELATED APPLICATIONS

This is a Continuation-In-Part Application based upon copending U.S. patent application Ser. Nos. 07/232,750 filed Aug. 15, 1988; 07/456,123 filed Dec. 22, 1989; 07/513,338 filed Apr. 20, 1990; and 07/597904 filed Oct. 12, 1990.

BACKGROUND OF THE INVENTION

The present invention relates to a liquid crystal display device in general, and in particular to a display device with reduced unevenness of display. While liquid crystal display devices have taken many forms simple matrix type liquid crystal display devices are generally driven by a voltage averaging method. The liquid crystal panel, is provided with scanning and signal electrodes each having a resistance which is greater than zero (0) and a liquid crystal layer which acts as a dielectric. Therefore, the effective voltages at the display elements or dots formed by the intersection of each scanning electrode and signal electrode changes depending on the nature of the characters and the images displayed by the liquid crystal panel. This results in unevenness on the display device.

The problem described above has been known in the art. Many problem solving techniques have been used in the past, such as, a method of reversing the polarity of the voltage applied to the liquid crystal panel a plurality of times in one frame (hereinafter referred to as "line reverse driving method"). This method is described in Japanese Patent Application Laid-Opened Official Gazette No. 62-31825, No. 60-19195 and No. 60-19196.

Further, other methods for improving unevenness of display are known in the art such as the method described in Japanese Patent Application No. 63-159914 proposed by the present inventor, referred to as the "voltage correcting method".

The line reverse driving method is an effective method of improving unevenness of display caused by variations of the optical characteristics of the liquid crystal caused by changes in the frequency component of the applied voltage. The line reverse driving method is effective at improving the unevenness of display, but cannot completely remove the unevenness of display caused by changes in the frequency component of the applied voltage.

The unevenness of display can be improved by the voltage correcting method proposed by the present inventor. However, with the application of this method the unevenness of display such as described below has not been eliminated.

Referring to FIG. 1 the unevenness of display remaining after application of the voltage adjusting method is explained. FIG. 1 depicts a liquid crystal panel generally indicated as 1, composed of a liquid crystal layer 5, a first substrate 2 and a second substrate for sandwiching the liquid crystal layer 5 therebetween. A plurality of scanning electrodes Y1 through Y6 are formed on substrate 2 in the horizontal direction and a plurality of signal electrodes X1 through X6 are formed on substrate 3 in substantially the vertical direction. Each intersection of scanning electrodes Y1 through Y6 and signal electrodes X1 through X6 forms a display element (dot) 7. Display elements 7 marked with cross-hatching represent the lighting or illuminated state and blank display elements 7 represent the non-lighting or non-illuminated state. Further, FIG. 1 is depicted as a checkered pattern or matrix. The display panel of FIG. 1 is limited to a 6×6 matrix or 36 display elements for simplicity, however, in exemplary embodiments the number of display elements of liquid crystal panel 1 may be much greater.

In the voltage adjusting method, a scanning voltage correcting wave is applied to the scanning electrodes. For example, a scanning voltage correcting wave is applied to the left side of the scanning electrode, to vary the display pattern. Among the examples of the voltage correcting method of driving liquid crystal displays proposed by the present inventor in Japanese Patent Application No. 63-159914, the scanning voltage correcting wave is applied to every other line display, thereby, improving the unevenness of the display. Specifically, the correcting voltage is superimposed upon the non-selective voltage in accordance with the difference I between the number of lighting display elements on a scanning electrode and the number of lighting display elements on the following scanning electrode when the selection is moved from one scanning electrode to the next scanning electrode. However, in the case of the display subject shown in this figure, since the difference I is always zero (0), the correcting voltage is not applied to the non-selective voltage.

The signal voltage wave is fed alternatively to the signal electrodes from the upper and the lower ends of the signal electrodes, with each consecutive signal electrode receiving the signal voltage wave from the opposite direction. The liquid crystal panel 1 displays a "positive display" which becomes dark when the effective voltage applied to the display dot becomes higher.

When the display patter depicted in this figure is actually used, the display dots formed by electrodes X1, X3 and X5 are brighter on the upper portion, and become darker on the lower portion. On the contrary, the display dots formed by electrodes X2, X4 and X6 are brighter on the lower portion, and become darker on the upper portion. In other words, the effective voltage actually applied to the display dot is greatest in the dot most proximate to the source of the signal voltage wave, and the effective voltage decreases as the display dot increases in distance away from the signal voltage wave.

The following problems have been discovered through further experimentation on the unevenness of display. Particular reference is made to FIGS. 2(*a*) through (*c*) in order to explain the problems identified.

FIGS. 2(*a*) through (*c*) depict examples of actual driving waveforms (waveforms of applied voltage) applied to the electrodes of the liquid crystal panel shown in FIG. 1. In FIG. 2(*a*), the full line shows the voltage waveform on the signal electrode X3 in the position of display element D31 (the intersection of X3 and Y1) of FIG. 1. The dotted line shows the voltage waveform on the signal electrode X2 in the position of the display dot D21 (the intersection of X2 and Y1). The wave depicted with a full line and the wave depicted with a dotted line are drawn to be slightly shifted to distinguish them from each other and to facilitate the explanation. The two waveforms are actually superposed upon each other.

FIG. 2(*b*) shows the voltage waveform on signal electrode X1 in the position of display dot D21 or D31 in FIG. 1. FIG. 2(*c*) shows the difference between the voltage wave on scanning electrode Y1 and the voltage wave on signal electrode X3 in the position of display dot D31 in FIG. 1. The full line depicts the voltage wave applied to the display dot D31. Similarly, the dotted line in FIG. 2(*c*) depicts the voltage wave applied to display dot D21. The portion with hatching shows the difference in applied voltage between the lighting dot and the non-lighting dot, which is not the voltage difference causing the unevenness of display.

In the figure V0, V1, V2, V3, V4 and V5 represent the applied voltages. The selective and non-selective voltages are applied to the scanning electrode and the lighting and the non-lighting voltages are applied to the signal electrodes. The voltages V5, V3, V0 and V4 are defined as the first group of lighting, non-lighting, selective and non-selective voltages and the voltages V0, V2, V5 and V1 are defined as the second group of lighting, non-lighting, selective and non-selective voltages (hereinafter, the voltage wave applied to the scanning electrode is referred to as scanning voltage wave and the voltage wave applied to the signal electrode is referred to as the signal voltage wave). The first and second voltage groups are periodically switched. In this example, the voltage groups are switched after all the scanning electrodes Y1 through Y6 are applied with the selective voltage (this cycle is known as one frame, and it is represented by F1 and F2 in FIG. 2).

As shown in FIG. 2(*a*), since the distance between the display element D31 and the end portion applied with the signal voltage wave is short, the damping of the voltage wave is almost nonexistent and the applied signal voltage wave is applied as is without any rounding or damping. However, as shown in FIG. 2(b), since the distance between the dot D21 and the end portion applied with the signal voltage wave (hereinafter referred to as the "driving end") is large in the case of signal electrode X2 in the position of the dot D21, the result is a signal voltage wave having large damping and rounding.

In other words, the damping and rounding of the voltage wave is caused by an integrating circuit, which includes the electrical resistance internally within signal electrodes X1 through X6 and the condenser having the liquid crystal material as the dielectric. Therefore, when signal electrodes X1, X3 and X5 are changed from the lighting to non-lighting voltage and from the nonlighting to lighting voltage, a larger spike type noise is generated than when signal electrodes X2, X4 and X6 are changed from the lighting to non-lighting voltage and from the non-lighting to lighting voltage, when considering scanning electrode Y1. The spike type noise generated on scanning electrode Y1 by switching signal electrodes X1, X3 and X5 from the lighting to non-lighting voltage and from the non-lighting to lighting voltage, thereby, dominates. Therefore, as shown by the full line waveform shown in FIG. 2(*c*), the effective voltage applied to display element D31 decreases, and as shown by the dotted line, the effective voltage applied to display dot D21 increases.

Alternatively, in the case of scanning electrode Y6 shown in FIG. 14 the noise generated by the signal electrodes X2, X4 and X6 dominate. Further, the effective voltage applied to the display dot D26 decreases and the effective voltage applied to the display dot D3 increases.

Hereinafter we will refer to the mth signal electrode from the left side as signal electrode Xm, the nth scanning electrode from the upper portion of liquid crystal as scanning electrode Yn, and the display dot formed at the intersection of signal electrode Xm and scanning electrode Yn will be referred to as display element Dmn. Generally, when the selection of successive scanning electrodes moves from scanning electrode Yn to scanning electrode Yn+1, and the signal voltage wave applied to those signal electrodes receiving the signal voltage wave from the end portion depicted at the upper portion of FIG. 14, is such that the lighting voltage is successively applied when scanning electrodes Yn and Yn+1 are scanned (successive lighting display elements), the case is defined as a1. When the non-lighting voltage is successively applied when scanning electrodes Yn and Yn+1 are scanned (successive non-lighting display elements), the case is defined as b1. When the lighting voltage is applied to the display element formed on scanning electrodes Yn and the non-lighting voltage is applied to the scanning electrode Yn+1, the case is defined as cl. When the nonlighting voltage is applied to the display element formed on scanning electrodes Yn and the lighting voltage is applied to the scanning electrode Yn+1, the case is defined as d1.

Similarly, when the selection of successive scanning electrodes moves from scanning electrode Yn to scanning electrode Yn+1, and the signal voltage wave applied to those signal electrodes receiving the signal voltage wave from the end portion depicted at the lower portion of FIG. 14, is such that the lighting voltage is successively applied when scanning electrodes Yn and Yn+1 are scanned (successive lighting display elements), the case is defined as a2. When the non-lighting voltage is successively applied when scanning electrodes Yn and Yn+1 are scanned (successive non-lighting display elements), the case is defined as b2. When the lighting voltage is applied to the display element formed on scanning electrodes Yn and the non-lighting voltage is applied to the scanning electrode Yn+1, the case is defined as c2. When the nonlighting voltage is applied to the display element formed on scanning electrodes Yn and lighting voltage is applied to the scanning electrode Yn+1, the case is defined as d2.

The number of lighting display elements 7 on scanning electrode Yn that are applied with the signal voltage wave from one end portion of the display (the upper portion of FIG. 14) is $N1_{ON}$ and the number of non-lighting display elements 7 is $N1_{OFF}$. Further, the number of lighting display elements 7 on scanning electrode Yn+1 that are applied with the signal voltage wave from one end portion (the upper portion of FIG. 14) is $M1_{ON}$ and the number of non-lighting display elements 7 is $M1_{OFF}$. Similarly the number of lighting display elements 7 on scanning electrode Yn that are applied with the signal voltage waveform from one end portion (the lower portion of FIG. 14) is $N2_{ON}$ and the number of non-lighting display elements 7 is $N2_{OFF}$. Further, the number of lighting display elements 7 on scanning electrode Yn+1 that are applied with the signal voltage wave from one end portion (the lower portion of FIG. 14) is $M2_{ON}$ and the number of non-lighting display elements 7 is $M2_{OFF}$. The relationship between scanning electrodes and signal electrodes that are applied with signal voltage waves from one end portion (the upper portion of FIG. 14) is as follows:

$$N1_{ON}=a1+c1$$

$$N1_{OFF}=b1+d1$$

$$M1_{ON}=a1+d1$$

$$M1_{OFF}=b1+c1$$

Herein, the numeric value I1 is defined as follows:

$$\begin{aligned} I1 &= c1 - d1 \\ &= N1_{ON} - M1_{ON} \end{aligned}$$

Similarly, the relationship between scanning electrodes and signal electrodes that are applied with signal voltage waves from one end portion (the lower portion of FIG. 14) is as follows:

$$N2_{ON}=a2+c2$$

$$N2_{OFF}=b2+d2$$

$$M2_{ON}=a2+d2$$

$$M2_{OFF}=b2+c2$$

Herein, the numeric value I2 is defined as follows:

$$\begin{aligned} I2 &= c2 - d2 \\ &= N2_{ON} - M2_{ON} \end{aligned}$$

Further, the function I(k) is defined as follows:

$$I(k)=f(k)\cdot I1+f(L-k)\cdot I2.$$

The function f(k) is a function which decreases as k increases. The function f(k) shows that the spike type noise generated in the scanning electrode, by each signal electrode, increases as the signal voltage wave approaches the driving end (the end where the signal voltage wave is applied).

The character L indicates the total number of scanning electrodes. The relationship between k and L is as follows:

$$1 \leqq k \leqq L.$$

The absolute value of the function I(k) defines the spike type noise generated on the kth scanning electrode Yk when the selection is moved from the scanning electrode Yn to scanning electrode Yn+1. Thus, the function I(k) increase as the noise generated decreases. The direction in which the noise is generated dependent upon whether the value of the function I(k) is positive or negative.

In scanning electrode Yk, if the direction of the voltage spike type noise according to the function I(k) is in phase with the variation of the voltage wave applied to each signal electrode, then the effective voltage applied to the display element formed with the signal electrode and the scanning electrode Yk becomes lower, thereby, making the display element brighter. Alternatively, if the phases of the voltage spike I(k) and the signal electrode are reversed, then the effective voltage applied to the display element will be great, thereby, making the display element darker. Thus, unevenness of display would remain. The different types of unevenness remaining after the voltage correcting method will be explained with reference to FIGS. and 4.

Particular reference is made to FIGS. 3 and 4 , wherein liquid crystal panels with different display subjects are depicted. FIGS. 3 and 4 depict the same liquid crystal elements as FIG. 1. Thus, similar numbers are used to designate similar elements of the liquid crystal panel. The voltage correcting method of decreasing unevenness of display as described in Japanese Patent Application No. 63/159914 proposed by the present inventor describes applying a varied scanning voltage to the left side of the scanning electrodes Y1 through Y6 according to the pattern of the display elements 7 upon the display. Accordingly, the scanning voltage wave is varied by superimposing the correcting voltage upon the selective voltage in accordance with the number of lighting dots Z on the scanning electrode selected. In FIGS. 3 and 4 the congruence quadrangle is displayed in the position shifted to the left end and the right end respectively. Therefore, the same correcting voltage is applied to each scanning electrode Y1 through Y6 of the liquid crystal panel 1 when it is in a condition displaying either FIG. 3 or FIG. 4.

In FIG. 3 there is unevenness of display generated in the display quadrangle that is manifested in the form of horizontal darkening resulting from excess correcting voltage. On the contrary, in FIG. 4, the correcting voltage is not sufficient to cause unevenness by weft pulling. In FIG. 4 horizontal brightening remains because the condenser formed with the resistance of each scanning electrode Y1 through Y6 forming a part of the liquid crystal panel 1 forms an integral circuit and the lighting display element forms a condenser having larger capacitance as compared with the non-lighting dot. The interference causing rounding of the voltage wave of the lighting display element at a greater distance from the end of the scanning electrode applied with the scanning voltage wave (hereinafter the "driving end") is larger than the interference of the non-lighting display element at about the same position. Thus, larger rounding results in display elements that are more distanced from the driving end of the scanning voltage wave. Thus, if the lighting dot exists in a position distanced from the driving end of the scanning electrode Y1 through Y6, the scanning electrode wave including the correcting voltage is rounded. Therefore, the effective voltage applied to the display dot decreases.

In a matrix with s scanning electrodes Y1 through Ys, the numerical value z' representing the unevenness of display by weft pulling, may be calculated by the following formula:

$$z' = \sum_{i=1}^{p} q(i) * \delta(i)$$

wherein, i designates the signal electrode upon which the display dot is turned on, for example, $X_i$ (i=1, 2, 3, . . ., P) designates the number of signal electrodes X1 through Xp.

Herein, the letters s and p designate the number of scanning electrodes and signal electrodes respectively.

The function q(i) is a function that increases as the value i increases.

The function δ(i) is 1 when the display element positioned in i on the selected scanning electrode is lighting, and it is 0 when the display dot positioned in i is non-lighting.

Therefore the numerical value z' increases greatly on display element most distanced from the driving end of the scanning electrode.

Thus, the unevenness of display has not been completely removed by the voltage correcting method of removing unevenness of display by the weft pulling of conventional displays. The numerical value z may be obtained by the following formula:

$$z = \sum_{i=1}^{p} \delta(i)$$

The unevenness resulting in the mechanisms described above have caused a decrease in the quality of the display. By this invention applicant seeks to improve the evenness of display.

SUMMARY OF THE INVENTION

Generally speaking in accordance with the invention, a liquid crystal display device having an improved ability to prevent unevenness of display is provided. This is accomplished through determining the specifics of the pattern to be displayed in terms of mathematical relationships, based on the positional relationship of the lighted display elements on the display device. The method for correcting being in accordance with the determined values in the predetermined mathematical relationships. Thus, resulting in the unevenness of display being improved, the quality of display being increased, and the visual quality being increased by considering the positional relationship between the display pattern and the driving end of the scanning electrode or the signal electrode taking into consideration the extracted amount calculated.

A liquid crystal display is formed with two substrates and a liquid crystal layer formed therebetween in accordance with the invention. A group of scanning electrodes are formed on one substrate. A group of signal electrodes is formed on the other substrate. A scanning voltage wave is applied to at least one end of each scanning electrode and a signal voltage wave is applied to at least one end of each signal electrode. The scanning electrodes intersect the signal electrodes, providing display elements on the liquid crystal display at each intersection. In order to reduce unevenness of display a correcting voltage is superimposed upon at least one of the scanning voltage wave or the signal voltage wave in accordance with patterns with images and characters dictated by the liquid crystal panel. The value of the correcting voltage that is superimposed upon the scanning voltage wave or signal voltage wave may be varied in accordance with at least one of the positions of the display element relative to the driving end of the scanning electrode or the signal electrode.

One embodiment corrects the non-selected voltage applied to the scanning electrodes dependent on the distance of its selected scanning electrode from the driving end of the signal electrode. A second embodiment corrects the selective voltage applied to a scanning electrode depending on the distance of the lighting display elements from the driving end of the scanning electrodes.

Accordingly it is an object of the present invention to provide an improved method for driving a liquid crystal display.

Another object of the present invention is to provide a method for driving a liquid crystal display which prevents unevenness in display density at the display elements of the matrix.

Still another object of the invention is to prevent unevenness of display by varying the amount of correcting voltage supplied in every electrode.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawing(s), in which:

FIG. 7(*b*) and FIG. 7(*b*) (cont'd) are timing diagrams showing the timing sequence of shift register 207, latch circuit 208 and detect circuit 210;

FIG. 7(*c*) is a block diagram of detect circuit 210;

FIG. 7(*d*) is a block diagram of level shifter circuit 212;

FIG. 8 is a block diagram of the correcting circuit of FIG. 5;

DETAILED DESCRIPTION OF THE PREFERRED EMBODIMENTS

Referring now to FIGS. 5–11, a first embodiment of the device and method of correcting the unevenness of display generated when the checkered pattern is displayed will be described.

The degree of unevenness of display is determined by subtracting the number of lighting display elements of selected scanning electrode Yn from the number of lighting display elements on the following scanning electrode Yn+1, with consideration given to the distance between the scanning electrodes considered and the driving end of the signal electrode. Therefore, wave correcting can be carried out by applying the result of the above calculation to the liquid crystal display device. This process will be further displayed through the use of concrete examples.

Figure 5:
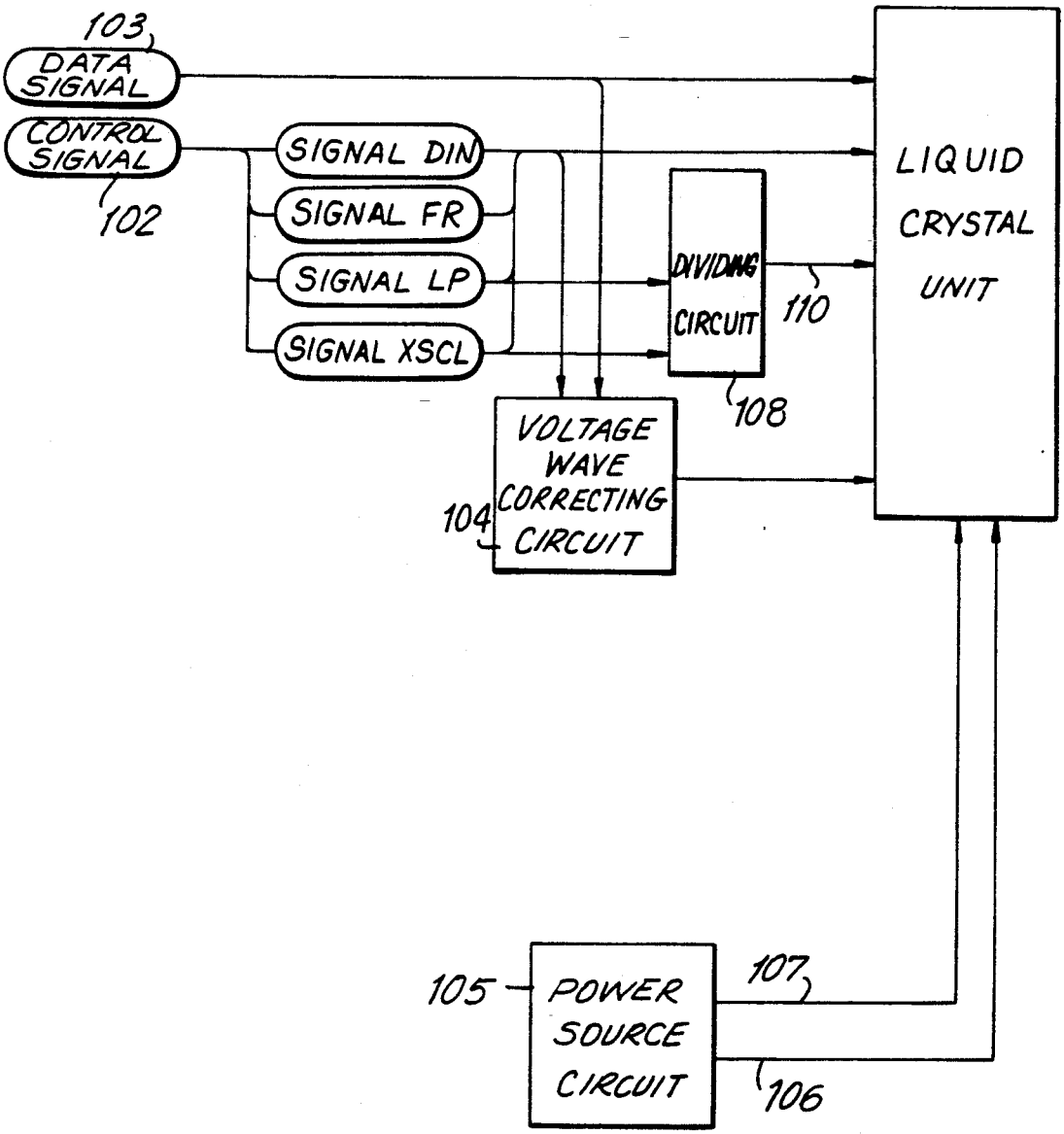
FIG. 5 is a block diagram showing the structure of the first embodiment of the liquid crystal display device of the present invention.

FIG. 5 depicts a block diagram of the first embodiment of the present invention. A liquid crystal unit 101 is provided with a liquid crystal panel 1, a scanning electrode driving circuit 205 and a signal electrode driving circuit 213. A sequential control signal circuit 102 controls the operations of the liquid crystal display device, by providing latch signal LP, frame signal FR, data-in signal DIN, X driver shift clock signal XSCL and other control signals. Data signal circuit 103 provides the data signal which determines the display pattern The data signal is varied at the leading edge of X driver shift clock signal XSCL, and is supplied to liquid crystal unit 101. A voltage wave correcting circuit (hereinafter referred to as "correcting circuit") 104 is also varied at the trailing edge of signal XSCL, and produces a correcting voltage wave, which is supplied to liquid crystal unit 101 by line 109. Power source circuit 105 produces Y power voltages on line 106 in the form of two group of voltages which are applied to the scanning electrodes, and X power voltages on line 107 in the form of two groups of voltages which are applied to the signal electrodes. Latch signal LP and X shift clock signal XSCL are input to dividing circuit 108, which produces a synchronized clock signal on line 110 (hereinafter referred to as "correcting clock signal").

Figure 6:
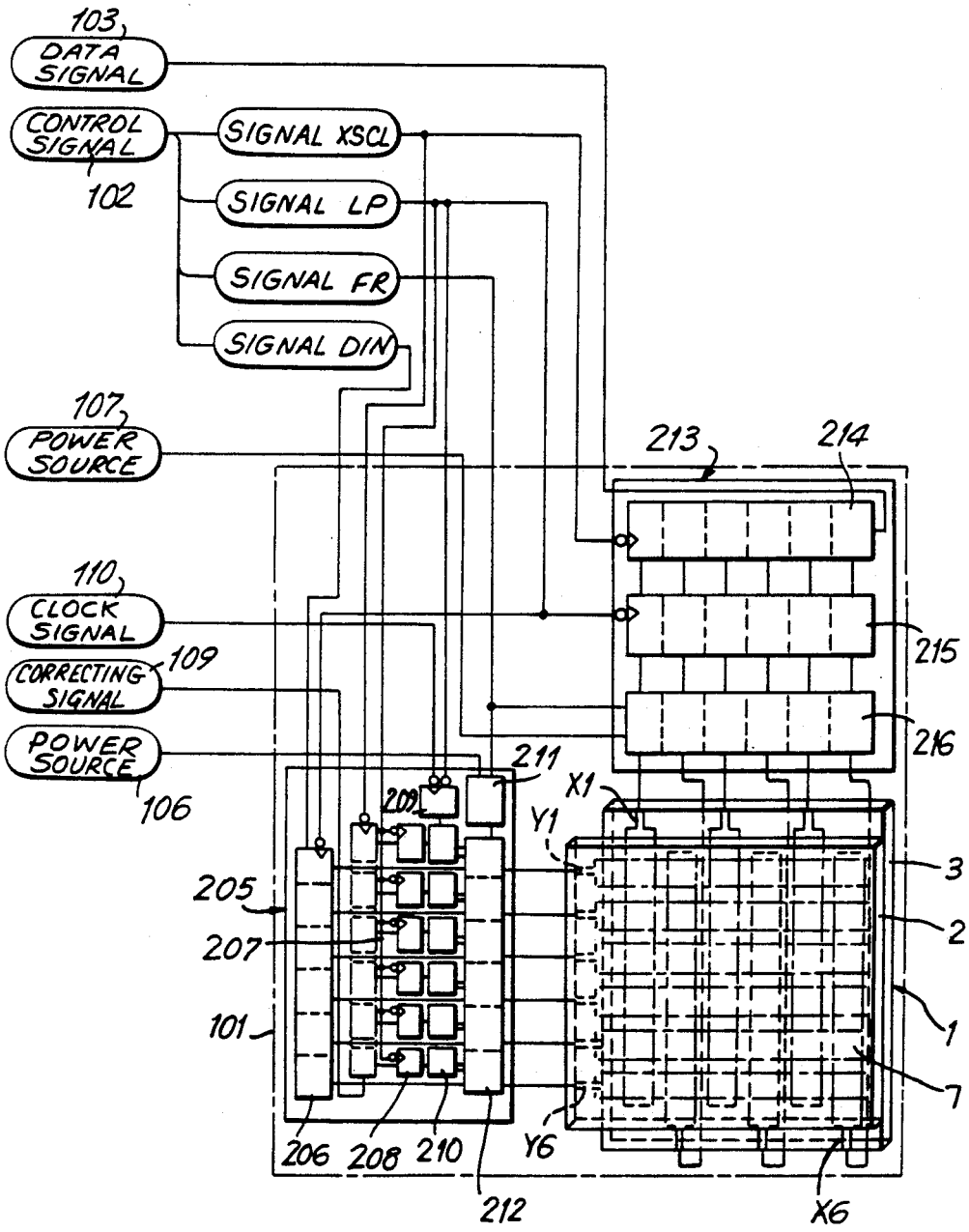
FIG. 6 is a block diagram and schematic view of the liquid crystal unit of FIG. 5.
Figure 7A:
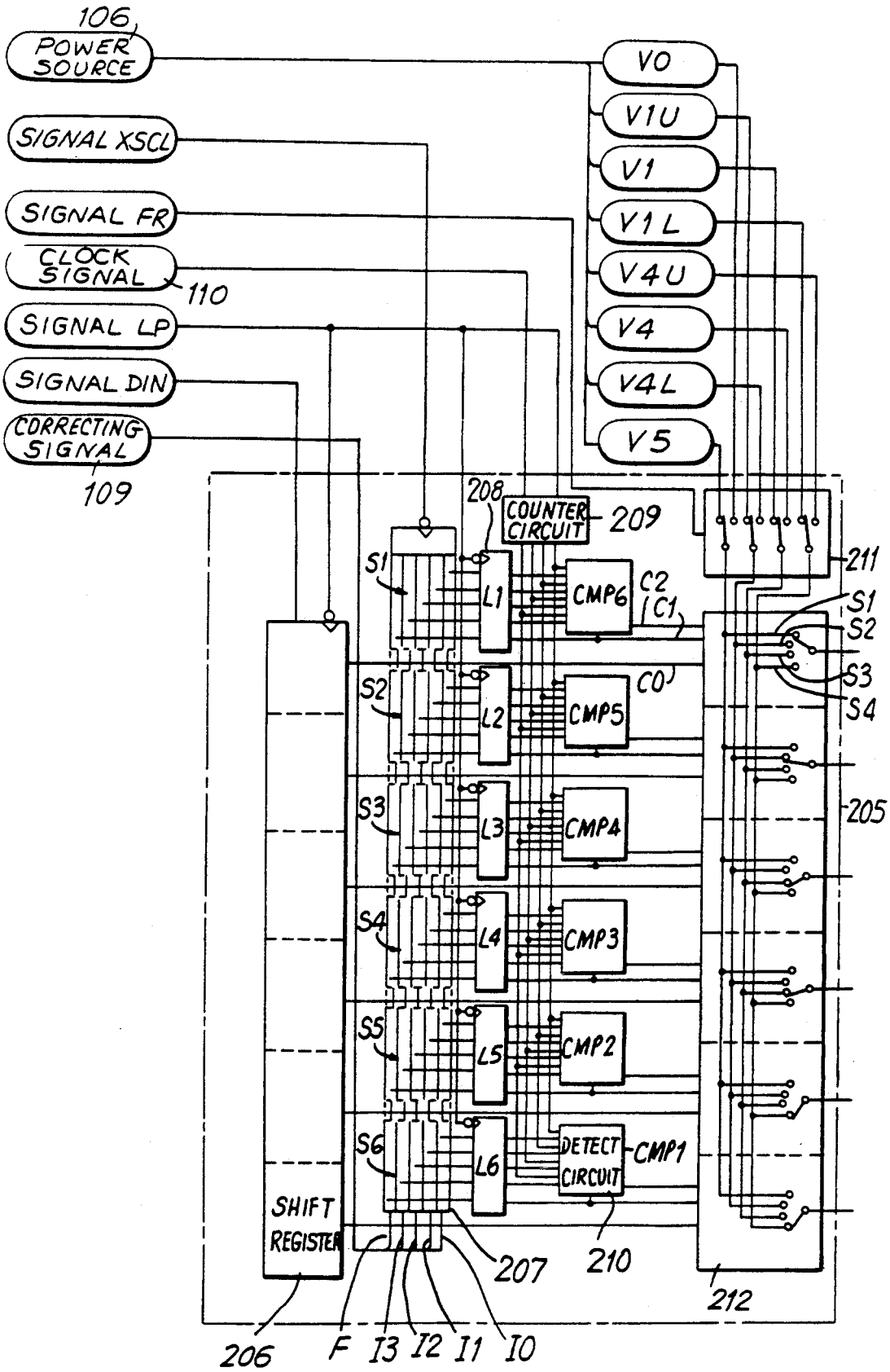
FIG. 7(*a*) is a circuit diagram of the scanning electrode driving circuit of FIG. 5.
Figure 7B:
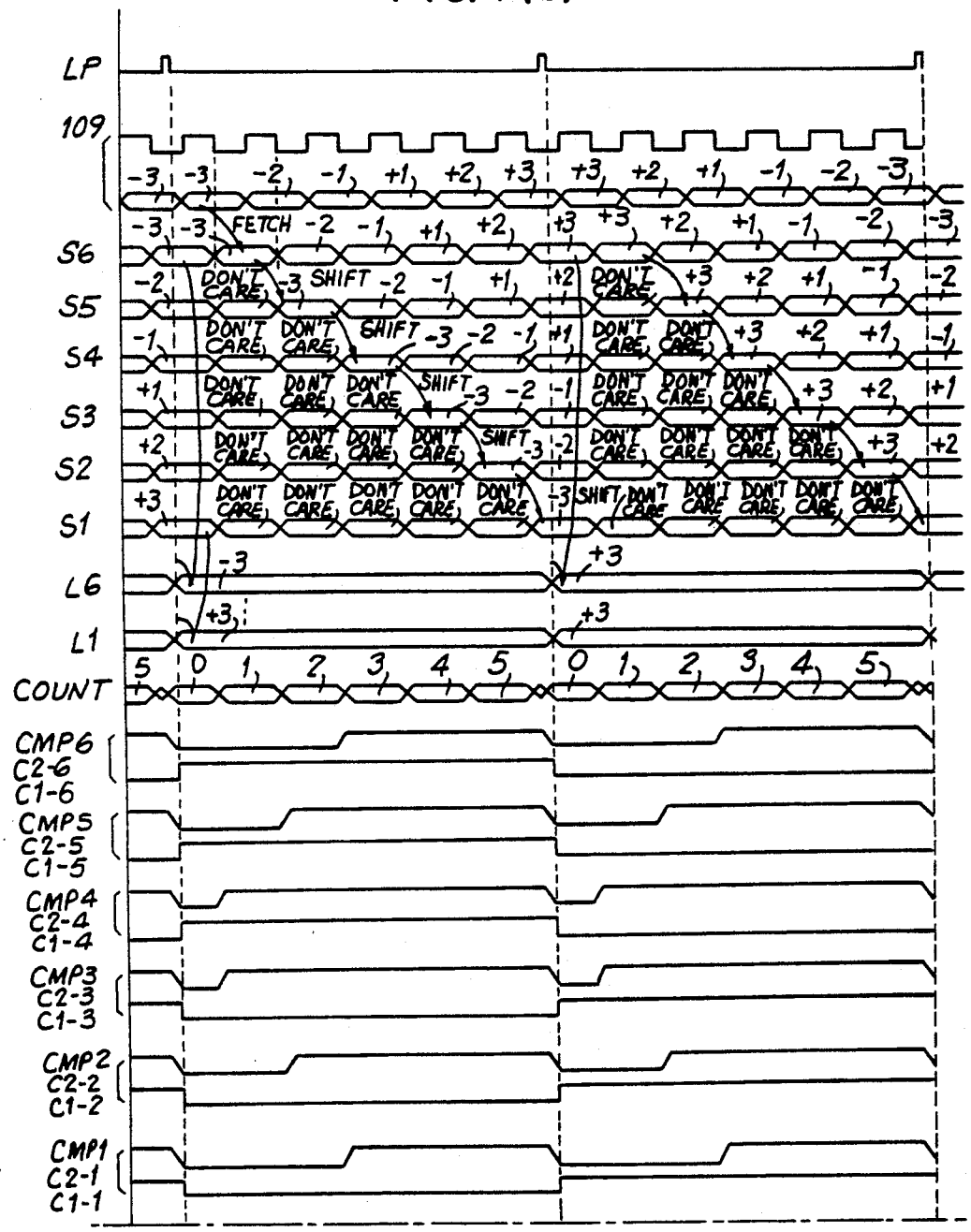
Figure 7B:
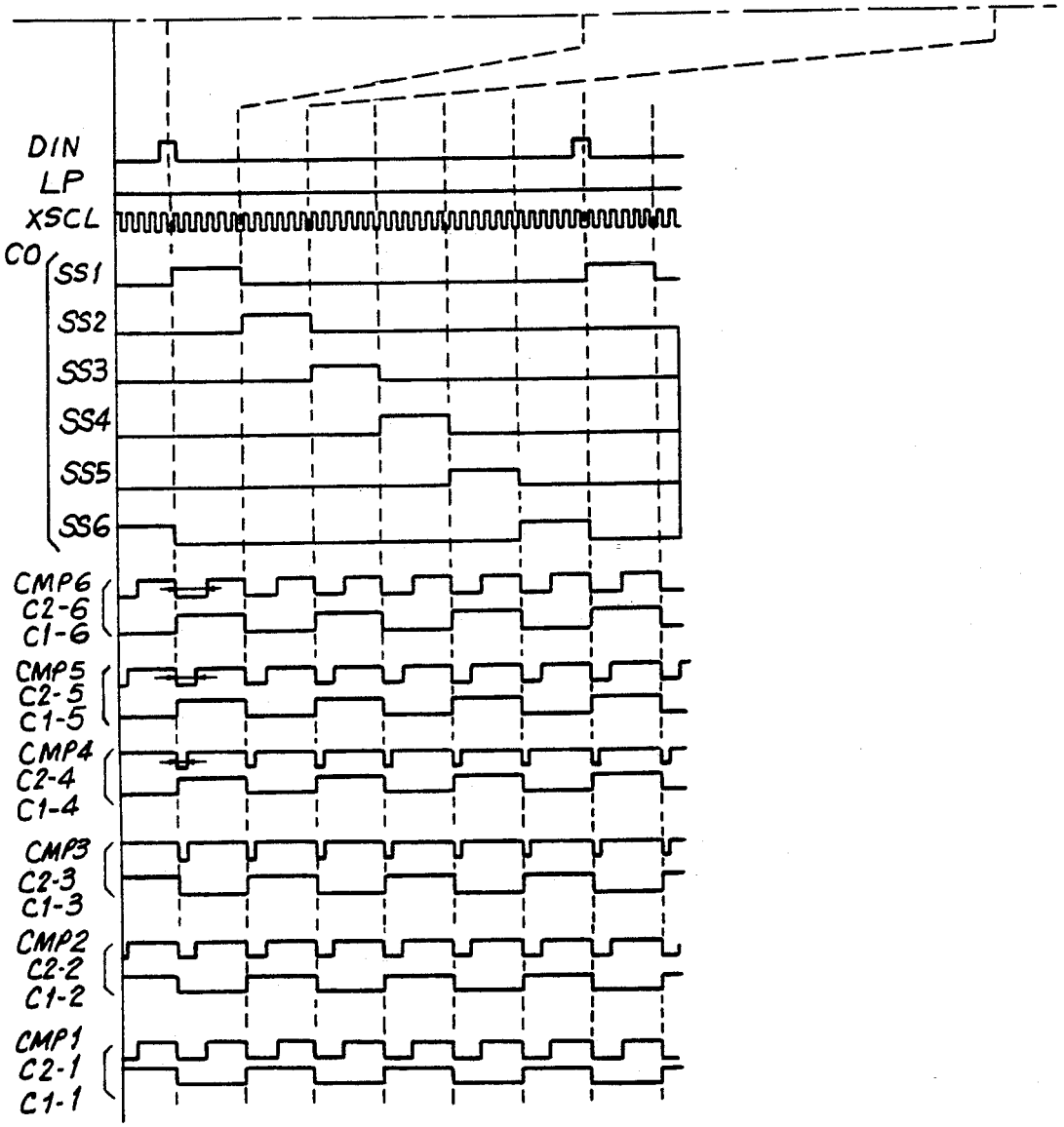
Figure 7C:
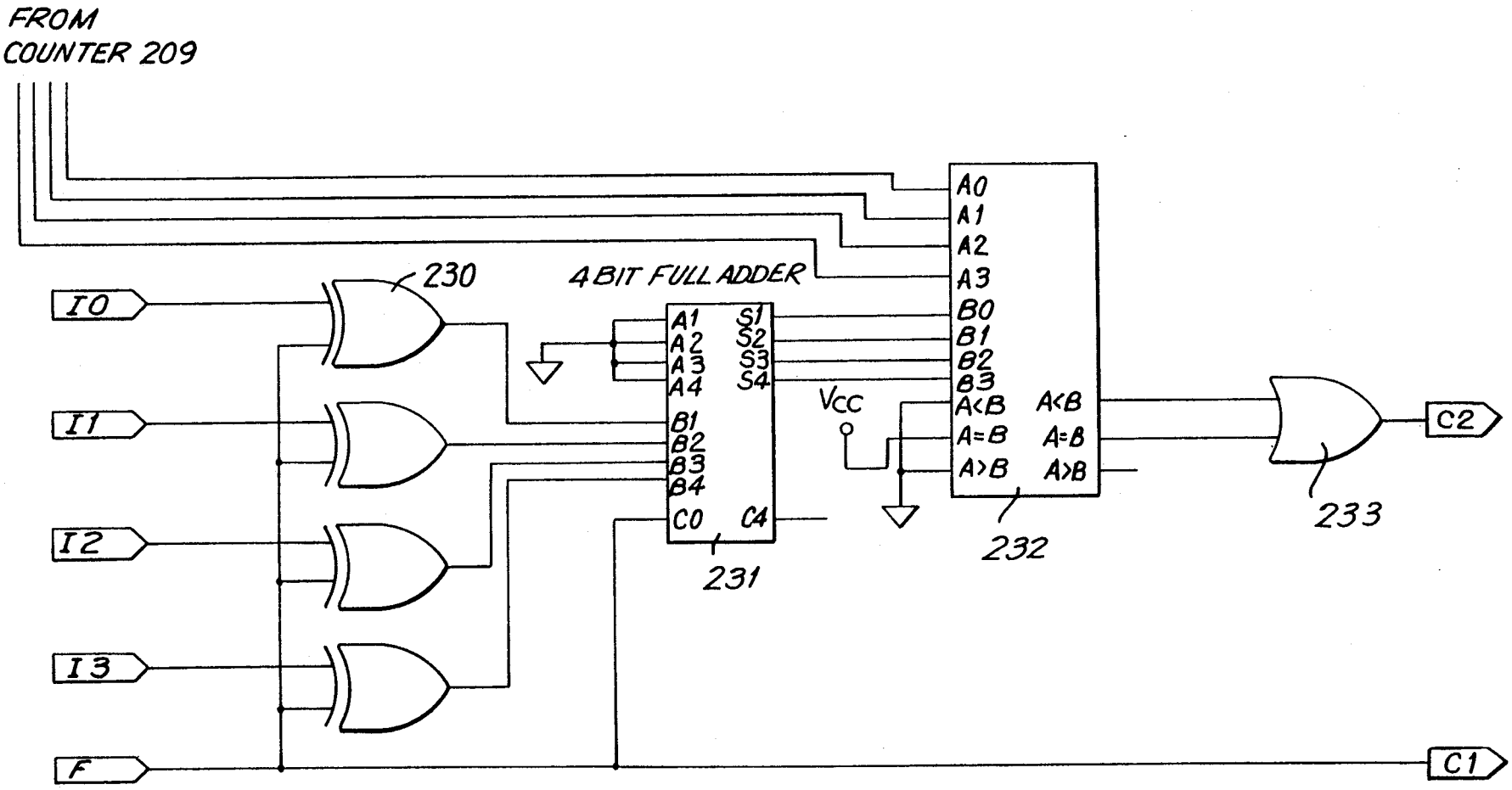
Figure 7D:
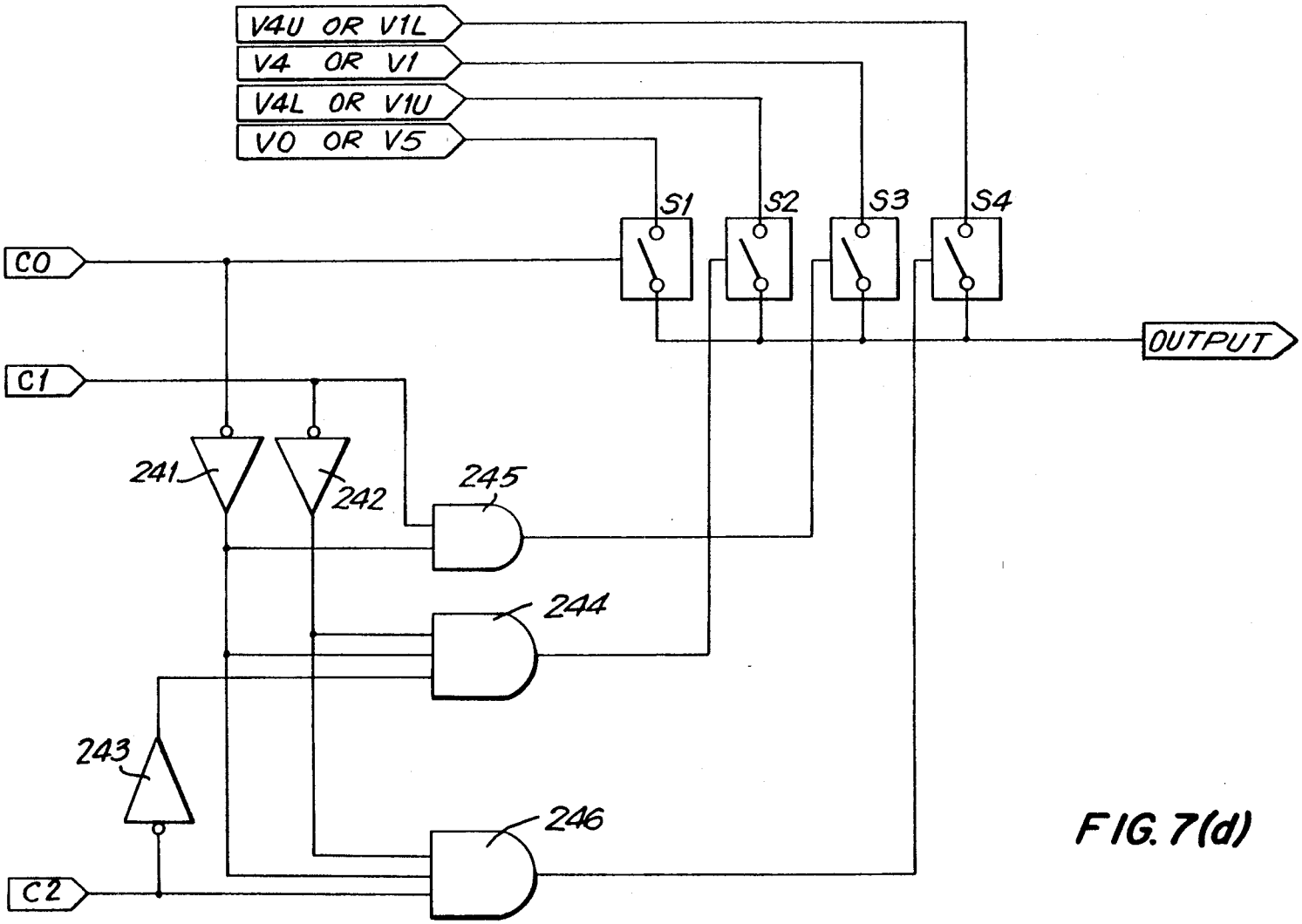

Reference is next made to FIG. 6, wherein a detailed block diagram of the liquid crystal unit 101 of FIG. 5 is depicted. Liquid crystal panel 1 is comprised of scanning electrodes Y1 through Y6 arranged on substrate 2 and signal electrodes X1 through X6 arranged on substrate 3. A liquid crystal layer is interposed between substrates 2 and 3. Signal electrodes X1, X3 and X5 have terminals for supplying the signal voltage wave at the upper end portions thereof, and scanning electrodes X2, X4 and X6 have terminals for supplying the signal voltage wave at the lower end portions thereof. Display elements 7 are formed by the intersection of scanning electrodes Y1 through Y6 with signal electrodes X1 through X6. The liquid crystal panel 1 of FIG. 6 is a 6×6 matrix. This Example is used for simplification and explanation. As hereinbefore mentioned, liquid crystal displays can be and usually are formed of substantially larger matrices and the arrangement according to the invention is applicable to such larger matrices.

The scanning electrode driving circuit or Y driver 205, a specific detailed embodiment which is shown in FIG. 7, is provided with a shift register 206 gated closed by the trailing edge of latch signal LP and receiving the data-in signal DIN as data. Shift register 206 has a number of bits equal to the number of scanning electrodes Y1–Y6. The outputs of shift register 206 are coupled to level shifter circuit 212. Level shifter circuit 212 is controlled by switch circuit 211 as described below. Shift register 207 is provided with a number registers equal to the number of bits of shift register 206. The contents of shift register 207 are shifted simultaneously to latch circuit 208. Latch circuit 208 is provided with a number of latches equal to the number of bits of shift register 207, each of which is output to a coincidence circuit of coincidence detect circuit 210, the outputs of which are also applied to level shifter circuit 212. Coincidence detect circuit 210 is controlled by counter circuit 209 as described below. The outputs of level shifter circuit 212 are led to each corresponding scanning electrode Y1 through Y6 of liquid crystal panel 1.

As noted above, data-in signal DIN and latch signal LP function as data and shift clocks, respectively, for shift register circuit 206 of scanning electrode driving circuit 205. On the trailing edge of latch signal LP, data-in signal DIN is input to shift register circuit 206 and then transferred at successive trailing edges of latch signal LP. At this moment, signal DIN, which takes a high electric potential "H" as active "1", is outputted once at an interval defined typically by the number of scanning electrodes Y1 to Y6 in liquid crystal panel 1, or more than the number of latch signal LP. Thus, the data active "1" is passed through the registers of shift register 206, the other registers becoming a non-active "0". Each register outputs the subject of the register either active "1" or non-active "0" as the control signal C0. Control signal C0 is input into level shifter 212.

Shift register circuit 207 is provided with a plurality of registers. In the present example, each register is provided with five (5) bits. The shift register circuit is operated by the Y correcting shift clock (hereinafter referred to as "signal YCSCL" —signal XSCL being used in this example), the intensity signal (which is four (4) bits in the present example, I0 through I3) for determining the amount of correcting voltage defining the correcting signal 109 and the coding signal F for determining the polarity of correcting voltage, the intensity and coding signals being sequentially taken by the signal XSCL from the correction voltage wave on line 109.

Latch circuit 208 takes the contents of shift register circuit 207 by means of latch signal LP. Counter circuit 209 is an up counter having a similar number of bits to that of the intensity signal I0 through I3. Counter 209 receives the up count from the correcting clock signal on line 110 and is reset by latch signal LP.

Coincidence detect circuit 210 detects a coincidence by comparing a register therein that corresponds to latch circuit 208 with the output of counter circuit 209. Control signal C2 in an active "1" state is output from coincidence detect circuit 210 when coincidence detect circuit 210 detects the coincidence. Coding signal F is input into shift register circuit 207 from line 109. Coding signal F is active "1" when a negative value is input. The numerical value one (1) is added to each bit of the shift register (I0 through I3), thus reversing each bit when coding signal F is active "1". As noted above, the contents of each register of shift register circuit 207 is latched by latch circuit 208 by the trailing edge of latch signal LP. The bit of each shift register corresponding to coding signal F is defined as control signal C1 and is applied both to coincidence circuit 210 and level shifter circuit 212.

Switching circuit 211 receives input from the Y power source voltages from line 106 in the form of voltages V0, V1U, V1, V1L, V4U, V4, V4L and V5. These voltages are divided into two groups. The first voltage group consists of V0, V4U, V4 and V4L, and the second voltage group consists of V5, V1L, V1 and V1U. These groups are selected by switching circuit 211 according to frame signal FR.

The voltages V0, V4U, V4 and V4L are defined as the selective voltage, the correcting voltage (U), the non-selective voltage, and the correcting voltage (L) of the first group, respectively. The correcting voltages (U) and (L) are collectively called the correcting voltages. Similarly, the voltages V5, V1L, V1 and V1U are defined as the selective voltage, the correcting voltage (U) the non-selective voltage and the correcting voltage (L) of the second voltage group, respectively.

Level shifter circuit 212 is provided with a plurality of switches having four input circuits (S1, S2, S3, S4) and one output connecting point. When control signal C0 from shift register 206 is "1", each switch selects input S1, which is the selective voltage.

When signal C0 is "0" and control signal C2 from coincidence detect circuit 210 is "1", each switch selects input S3, which is the non-selective voltage.

When the control signals C0 and C2 are both "0" and control signal C1 from latch circuit 208 is "0", each switch selects input S2 which is the correcting voltage (U), and when C1 is "1" each switch selects input S4, which is the correcting voltage (L).

Y driver 205 is generally discussed above. Shift register 207 of Y driver 205 is structured to be five (5) bits for intensity signal I0 through I3 and coding signal F. It is possible to increase or decrease the number of bits of shift register circuit 207 by varying the number of bits of the intensity signal.

As shown in FIGS. 6 and 7, the number of registers 206, shift register circuits 206 and 207, latches of latch circuit 208, coincidence detect circuits of coincidence detect circuit 210 and switches forming level shifter circuit 212 coincide with the number of scanning electrodes Y1 through Y6 of the liquid crystal panel shown.

With particular reference to FIG. 7(*a*) the operations of Y driver 205 is explained in greater detail. Data-in signal DIN is input into shift register 206 and is output in sync with latch signal LP to level shifter circuit 212. Level shifter circuit 212 then sequentially outputs the selective voltage corresponding thereto (hereinafter the switch which outputs the selective voltage is referred to as "selected switch", and the switch which outputs other voltages is referred to as "non-selected switch"). The intensity signal I0 through I3 and the coding signal F are input into shift register circuit 207 from 109 upon receipt of synchronized signal YCSCL (Signal XCSCL is substituted for signal YCSCL in this example). This results in correcting voltage (U) or (L) being output from each non-selected switch until the numerical value being counted up in counter 209 by the correcting clock coincides with the absolute value indicated by the intensity signals I0 through I3. The latch circuit 208 outputs control signal C1 which is input by coincidence detect 210 to determine the output of the correcting voltage (U) or (L). In other words, coding circuit F is determined to be either "0" or "1" to determine if correcting voltage (U) or (L) is required. The appropriate correcting voltage is applied by the corresponding switch of level shifter circuit 212 until intensity signals I0–I3 coincide with the numerical value of counter circuit 209, then each non-selected circuit outputs the nonselective voltage. Thus, the non-selected switch outputs the appropriate correcting voltage for as long a period of time as the absolute value of the numeric value indicated by the intensity signals I0 through I3.

Figure 1:
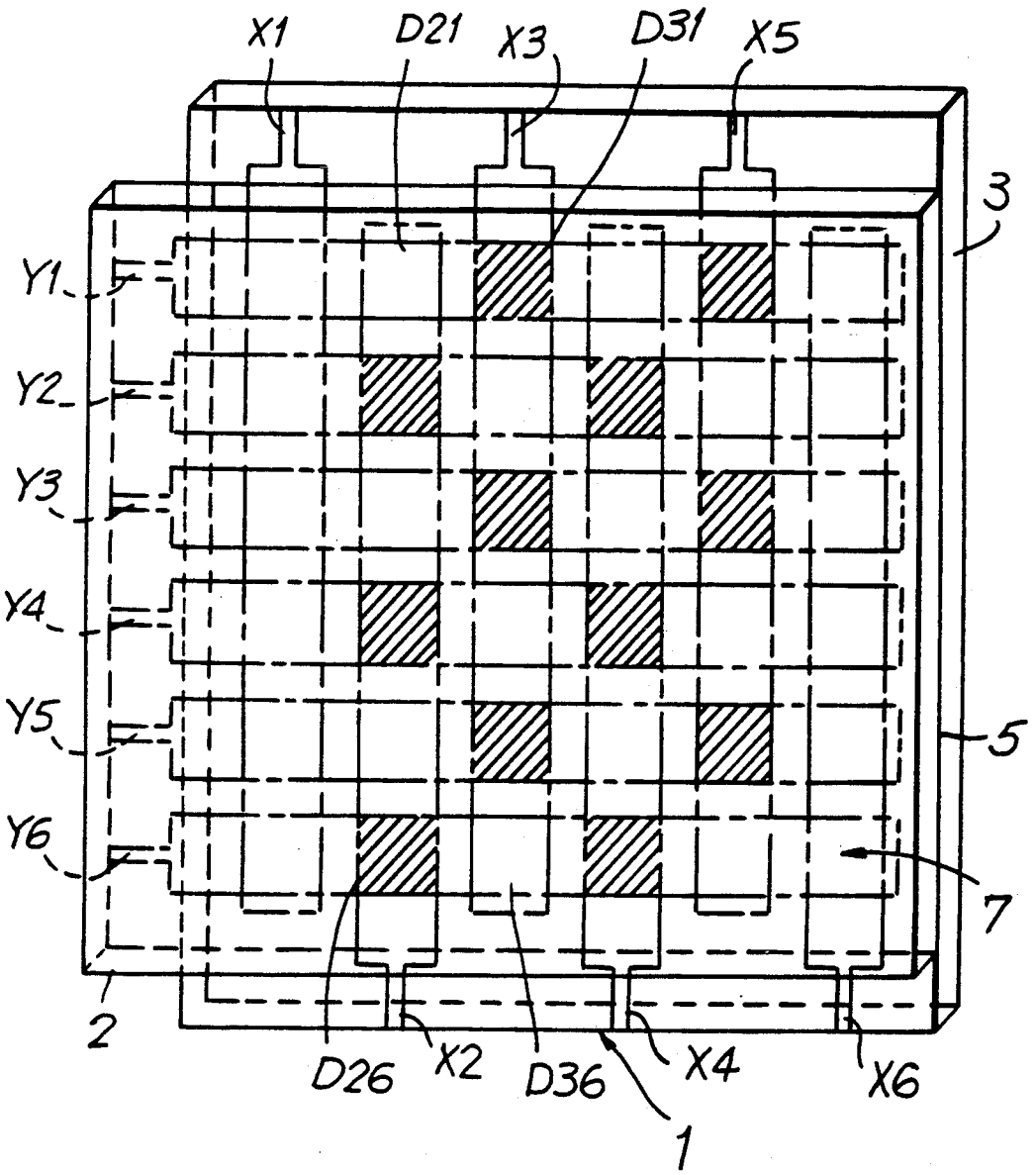
FIG. 1 is a schematic perspective view of a liquid crystal panel showing an example of a displayed pattern.
Figure 2A:
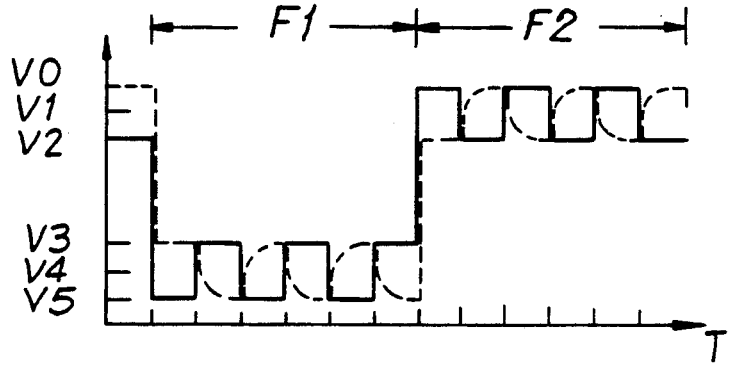
FIGS. 2(*a*)-(*c*) are waveform diagrams showing the voltage waveforms conventionally applied to the liquid crystal panel when the pattern shown in FIG. 1 is displayed.
Figure 2B:
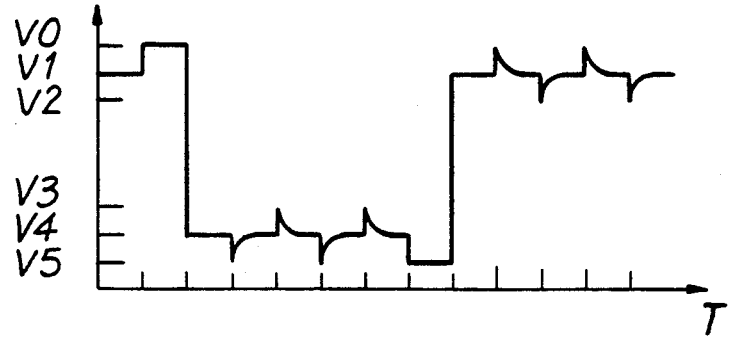
Figure 2C:
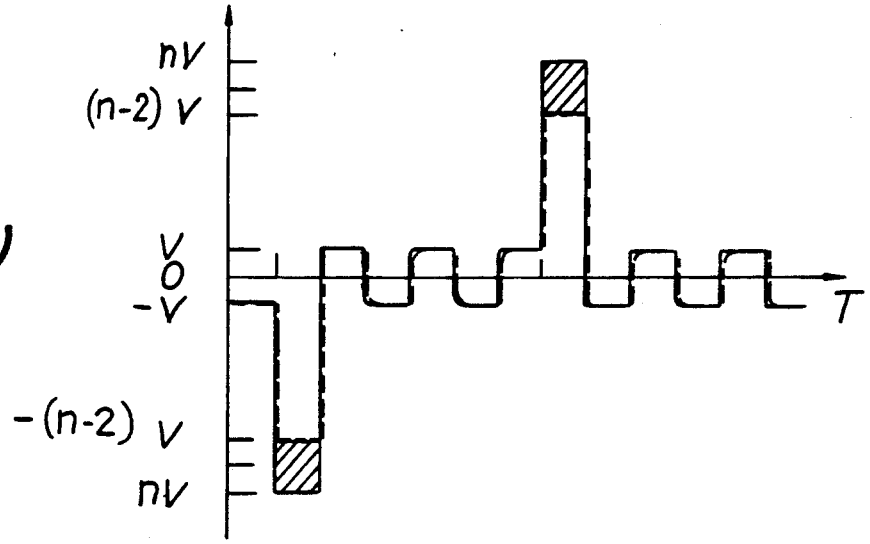

With particular reference to FIG. 7(*b*) the timing sequence of shift register 207 is explained in detail. Intensity signal I3 through I0 and coding signal F are output from correcting circuit 104 of FIG. 1 in sync with the leading edge of clock signal XSCL. The signal output from correcting circuit 104 is designated as correcting signal 109. As depicted in FIG. 8 correcting signal 109 includes clock signal XSCL applied as the clock to shift register 107. Correcting signal 109 is received by shift register S6 in sync with the trailing edge of signal XSCL, and then it is sequentially shifted to shift registers S5, S4, . . . , S1, in order in sync with the trailing edge of signal XSCL.

Latch circuit 208 receives the correcting data in sync with signal LP. Latch L1 receives the first data from shift register S1 in sync with signal LP, as does latch L2 receive the second data from shift register S2, latch L3 receive the third data from shift register S3, . . . , and latch L6 receive the sixth data from shift register S6. The data received from shift register 207 is the correcting data from correcting signal 109. This data is i the form of five bits, coding signal F is the first and intensity signal I3 through I0 are the remaining four (4).

With particular reference to FIG. 7(*c*) the operation of coincidence detect 210 is explained. Coincidence detect 210 receives the coding signal F and intensity signals I0 through I3 from latch circuit 208. The coding signal F and intensity signals I0 through I3 are calculated as described in connection with correcting circuit 104 of FIG. 8. In short, the difference between the number of lighting elements of selected scanning electrode Yn and the number of lighting elements of the next sequential scanning electrode Yn+1 determines the value of intensity signal I0 through I3. When the value of I0 through I3 is a negative value, it is expressed by five bits, namely coding signal F and intensity signal I0 through I3. Coding signal F performs the function of correcting the negative value. Coding signal F corresponds to the "borrow" commonly used in a logic circuit, microcomputer or the like when expressing the negative value in binary by the 2's compliment (0 or 1). In a binary system, a negative value is expressed by the 2's compliment.

In FIG. 7(*c*), the negative value is expressed by the 2's compliment of the positive number. Signal F is "1" and intensity signals I0 through I3 representing the negative value or 2's compliment of the positive number.

For example, −3 is expressed in the binary system by means of signal F and intensity signals I0 through I3 as follows:

| (F) | I3 | I2 | I1 | I0 | |
|---|---|---|---|---|---|
| (1) | 1 | 1 | 0 | 1 | = −3 |

Since F=1 the number is a negative value. Therefore, each bit line 1101 must be inverted, therefore, resulting in the binary information 0010. This inversion is accomplished by exclusive-OR gates 230. When 1 is input as the information on signal F in exclusive-OR gates 230 all bits are inverted, alternatively, when 0 is input into exclusive-OR gates 230 the bits remain the same.

Four bit full adder 231 is used to add 1 to the inverted number output from exclusive-OR gates 230 to obtain the absolute value of the original negative number input. Looking at the example above, the absolute value of −3 is obtained by adding 1 to 0010;

```
  0010
+)0001
  0011 = 3
```

Note that 1 is added only when signal F is "1".

Alternatively, when signal F is "0" intensity signals I3 through I0 represent a positive number. Since signal F equals "0" the same data input into exclusive-OR gates 230 is output from exclusive-OR gates 230, thus, exclusive-OR gates 230 act only as a buffer circuit. Furthermore, 0 is added to the four bit full adder 231, therefore, no change results. Thus, the original data inputted into exclusive-OR gates 230 is output through four bit full adder 231.

The output signal C2 of detect circuit 210 is 0 only when the value of the intensity signal which is applied to the detect circuit is smaller than the value of the counter. The value of control signal C2 is obtained by the output of OR gate 233. OR gate 233 is input with the output of magnitude comparator 232. Magnitude comparator 232 compares the absolute value of the intensity signals I3–I0 output from full adder 231, with the output from counter 209. Magnitude comparator 232 outputs "1" when the value in counter 209 is less than or equal to the absolute value of the intensity signals I3–I0 output from full adder 231. Thus, control signal C0 is the logical sum of A=B and A<B.

With particular reference to FIG. 7(*d*) the structure of level shifter circuit 212 is described. Switches S1 through S4 turn on in accordance with coding signals C0, C1 and C2. Coding signal F is used to distinguish between the U and L correcting voltages.

Switch S1 is turned on when coding signal C0 is "1".

Switch S2 is turned on when coding signal C0, C1 and C2 are all in the "0" state. This is because coding signals C0, C1 and C2 are transmitted through inverters 241, 242 and 243 respectively. Then the inverted bits are added in AND gate 244, and the resulting signal is sent to switch S2.

Switch S3 is turned on when coding signal C0 is "0", and coding signal C1 is "1". This results because AND gate 255 is input With coding signal C1, and the output of inverter 241. Inverter 241 is input with coding signal C0. Thus, switch S3 is on when coding signal C0 is "0" and C1 is "1".

Switch S4 is on when coding signals C0, C1 and C2 receive the information "0", "0" and "1" respectively. Switch S4 receives its information from AND gate 246. AND gate 246 receives its information from inverters 241 and 242 which receive their input from coding signal C0 and C1 respectively. Coding signal C2 is input into AND gate 246 directly. Thus, AND gate 246 outputs active 1 when coding signal C0, C1 and C2 are "0", "0" and "1" respectively.

Referring to FIG. 6, in general the signal electrode driving circuit (hereinafter referred to as "X driver") 213, is provided with shift register circuit 214, latch circuit 215 and level shifter circuit 216. The output of level shifter circuit 216 is lead to each signal electrode X1 through X6.

Shift register 214 receives the serial data signal from data signal circuit 103 for determining the display pattern of lighting and non-lighting display elements, and receives signal XSCL as the clock for loading this data signal in shift register 214. Shift register 214 provides parallel outputs to latch circuit 215, the lighting condition being active "1" and the non-lighting condition being non-active "0". Latch circuit 215 takes the output from shift register 214 upon receipt of its clock pulse, latch signal LP. Latch circuit 215 outputs the data representative of which of signal electrodes X1 through X6 are to be in the lighting or non-lighting condition. The outputs from latch circuit 215 are input into level shifter circuit 216. Level shifter circuit 216 outputs a predetermined voltage in accordance with the input from latch circuit 215 and frame signal FR. The predetermined Voltages output by level shifter circuit 216 are input into level shifter circuit 216 from power source circuit 105 along line 107. These voltages transmitted along line 107 are either the first group of voltages V5 and V3 or the second group of voltages V0 and V2. Hereinafter, the voltages V5 and V3 are defined as the lighting voltage and non-lighting voltage of the first group respectively, and the voltages V0 and V2 are defined as the lighting voltage and non-lighting voltage of the second group respectively. Signal FR is input into level shifter circuit 216, and is used to determine whether the first voltage group or second voltage group is output from level shifter circuit 216. If the contents of a latch of latch circuit 215 is "1", the lighting voltage of either group, as determined by frame signal FR, is output, and if the data is "0" the non-lighting voltage of either group is output.

In general liquid crystal unit 101 is structured as hereinabove described. The liquid crystal unit 101 synchronized by data-in signal DIN and latch signal LP The selective voltage is sequentially transmitted to electrodes Y1 through Y6, and the lighting or non-lighting voltage corresponding to the display pattern is transmitted to signal electrodes X1 through X6 in sync thereto. Thus, the liquid crystal panel 1 receives the scanning electrode and signal electrodes signals in sync, thereby, displaying the proper data. As hereinbefore mentioned, scanning electrodes Y1 through Y6 are applied with a correcting voltage having a length and polarity corresponding to the intensity signals I0 through I3 of the correcting signal 109 and coding signal F instead of the nonselective voltage. The actual structure of the liquid crystal unit is as described above.

With reference to FIG. 5 and FIG. 6 correcting circuit 104 counts the number of lighting display elements 7 on scanning electrode Yn and the number of lighting display elements 7 on the following scanning electrode Yn+1 (n=1, 2, . . . 5, and 6, however, it becomes 1 again when n=6 instead of n+1) of the liquid crystal panel 1. Through consideration of the above calculations and consideration of the distance between the driving end of the signal electrode and the display dot the intensity signals I0 through I3 and the coding signal F are thereby generated.

With particular reference to FIG. 8 correcting circuit 104 is provided with toggle flip-flop circuit (hereinafter referred to as "T-F/F") 401, gate circuits 402U and L, counter circuits 403 and 404, multiplier generator circuits 405U and L, counter circuits 406U and L, latch circuits 407U and L, arithmetic circuits 408U and L for carrying out a subtraction, memory elements 409U and L, latch circuits 410U and L, arithmetic circuits 411U and L for carrying out a multiplication, and arithmetic circuit 412 for carrying out an addition and a division.

T-F/F circuit 401 is reset to output zero (0) by signal LP. Further, the output from T-F/F 401 operates as an active input for AND gate 402U and operates as a nonactive (not) input for AND gate 402L. When the clock input signal XSCL is input into T-F/F circuit 401 the output is reversed. Therefore, when the data signal from data circuit 103 corresponding to even number electrodes X2, X4 and X6 of signal electrodes X1 through X6 of liquid crystal panel 1 shown in FIG. 6 is entered into gate circuit 402U and L in FIG. 8, only AND gate 402L becomes active to output the data signal as it is input. Accordingly, the output of gate circuit 402U becomes nonactive regardless of the data signal from data circuit 103. On the contrary, when the data signal corresponding to the odd number electrodes X1, X3 and X5 in FIG. 6 is entered into gate circuit 402U and L in FIG. 8 only and gate circuit 402U becomes active to output the data signal as it is input. Accordingly, the output of AND gate 402L becomes non-active regardless of the data signal from data circuit 103. Therefore, these three circuits are used in conjunction to separate the data signals being driven by the top portion of the respective signal electrodes from the data signals being driven through the bottom portion of the respective signal electrodes. The separated data signals are defined as "top data signal" and "bottom data signal".

Counter circuits 406U and L count the number of times within the period defined by latch signal LP a condition "1" representative of the lighting condition appears in every data signal separated as mentioned above. Counter 406U and L are closed by signal XSCL and reset to zero by latch signal LP.

When the output of gate circuit 402U and L is active an addition is carried out by the respective counter circuits 406U and L on the trailing edge of signal XSCL. $M1_{ON}$ and $M2_{ON}$ represent the result of the addition. This value is transmitted to latch circuits 407U and L by latch signal LP. Arithmetic circuits 408U and L conduct the subtraction of the output from latch circuits 407U and L (defined as $N1_{ON}$ and $N2_{ON}$) from the numeric value of $M1_{ON}$ and $M2_{ON}$ from counter circuits 406U and L. The result from this arithmetic is defined as follows:

$$I1 = N1_{ON} - M1_{ON}$$

$$I2 = N2_{ON} - M2_{ON}$$

Counter circuit 403 is an up-counter circuit that indicates which scanning electrode Y1 through Y6 of FIG. 6 is to receive the lighting voltage and which are to receive the nonlighting voltage. In the present example, counter circuit 403 counts up from 0 to 6 in response to latch signal LP, and then is reset to 0 by data-in signal DIN. The output of counter circuit 403 in FIG. 8 is transferred to an address in the memory circuit (hereinafter, referred to as "memory") 409U and L. When the selective voltage is added to scanning electrode Yn of the liquid crystal panel 1 shown in FIG. 6 the number in memory 409U or L is n−1. The above mentioned numerical values I1 and I2 are also written into the address indicated by counter 403 in memory 409U and L.

As hereinbefore stated counter circuits 406U and L count the number of lighting display elements $M1_{ON}$ and $M2_{ON}$ on scanning electrode Yn+1 while Yn+1 is applied with the selective voltage. The values $M1_{ON}$ and $M2_{ON}$, respectively subtracted from $N1_{ON}$ and $N2_{ON}$, produces values I1 and I2 respectively, wherein $N1_{ON}$ and $N2_{ON}$ are the values stored in latch circuit 408U and L, namely, the number of lighting display elements on scanning electrode Yn approximately before the selective voltage is applied to scanning electrode Yn+1, and this is written into the address n−1 of memory 409U and L. This L operation is repeated by changing the value of n from 0 to 5. Thus, in the memory 409U and L, the difference values I1 and I2 of the number of lighting display elements on scanning electrode Y1 and Y2 are stored in address 0.

Furthermore, in addresses 1 through 5, the differences between I1 and I2 of lighting display elements on each scanning electrodes Y2 and Y3, Y3 and Y4, Y4 and Y5, Y5 and Y6 and Y6 and Y1 are stored, respectively.

Counter circuit 404 is an up-counter circuit which indicates the condition of scanning electrodes Y1 through Y6. In the present example, counter circuit 404 counts up from 0 to 5 and is then reset to 0 by latch signal LP. The clock input into the counter 404 is known as signal YCSCL, but it can be any clock if the clock can count from scanning electrode Y1 through Y6 within one cycle of signal LP. In the present example signal XSCL is used as the signal YCSCL. The output of counter circuit 404 is used to address the output of multiplier generate circuits 405U and L.

The multiplier generator circuits 405U and L generate a multiplier which is a numerical value table taken from read only memory elements (hereinafter referred to as "ROM") and a diode matrix. This circuit generates the function f(k) which is used to obtain the parameters of input address. Multiplier generate circuit 405U stores the function table of the function f(k), wherein k designates the address. The function f(k) is a function that decreases when the value of k decreases. The formation of the function can be obtained by experimentation. A simplified linear function is provided below for explanation purposes.

$$k=0, f(0)=15$$

$$k=1, f(1)=14$$

$$k=2, f(2)=13$$

$$k=3, f(3)=12$$

$$k=4, f(4)=11$$

$$k=5, f(5)=10$$

Similarly, the multiplier generate circuit 405L is a circuit for generating a function which can be defined as f(L−k). Therein, L designates the number which is obtained by subtracting 1 from the number of scanning electrodes Y1 through Y6. In the present example, L=5.

Occurring simultaneously with selective voltage being applied to scanning electrode Yn of liquid crystal panel 1, the arithmetic circuits 411U and L of FIG. 8 carry out a multiplication by multiplying the contents of memory 409U and L in the address (n−1) indicated by the counter circuit 403 as latched into latch circuits 410U and L by the function of multiplier generate circuits 405U and L. The counter circuit 404 is an up-counter which counts in accordance with its clock signal, namely signal YCSCL. The output of counter circuit 404, in sync with signal YCSCL is applied to multiplier generate circuits 405U and L to determine the value output from the multiplier generate circuits 405U and L. In other words, the output of arithmetic circuits 411U and L is described below when it is synchronized with signal YCSCL.

$f(0)\cdot I1,\ f(5)\cdot I2$ $f(1)\cdot I1,\ f(4)\cdot I2$ $f(2)\cdot I1,\ f(3)\cdot I2$ $f(3)\cdot I1,\ f(2)\cdot I2$ $f(4)\cdot I1,\ f(1)\cdot I2$ $f(5)\cdot I1,\ f(0)\cdot I2$ Next, arithmetic circuit 412 adds the outputs of arithmetic circuits 411U and 411L, and the result obtained from the addition is divided by 4. The result is synchronized with signal YCSCL (signal XSCL in this case) and is output as follows (the obtained result is defined as I):

$$I=\{f(0)\cdot I1+f(5)\cdot I2\}/4$$

$$I=\{f(1)\cdot I1+f(4)\cdot I2\}/4$$

$$I=\{f(2)\cdot I1+f(3)\cdot I2\}/4$$

$$I=\{f(3)\cdot I1+f(2)\cdot I2\}/4$$

$$I=\{f(4)\cdot I1+f(1)\cdot I2\}/4$$

$$I=\{f(5)\cdot I1+f(0)\cdot I2\}/4$$

The result is divided by 4, because shift register circuit 207 of FIG. 7 is structured with four (4) bits except for code signal F. Therefore, the division is not substantial.

Using the background hereinbefore stated, the value I can be calculated by multiplying the differences I1 and I2 of the number of lighting dots on the scanning electrode Yn and Yn+1 with the function f(n−1) and f(L−n+1) respectively, and adding these results. The value I is then output in syn with signal XSCL during the period that scanning electrode Yn of liquid crystal panel 1 is selected. The equation looks as follows:

$$I=\{f(n-1)\cdot I1+F(L-n+1)\cdot I2\}/4$$

Value I calculated by this equation defines the intensity signals I0 through I3, which is determined to be positive or negative by the coding signal F, and is output as the correcting signal on line 109 of FIG. 5 together with signal XSCL. While the structure and operations of correcting circuit 104 may be as described above, other forms of correcting circuit 104 may be used. For example, in FIG. 8, $I=\{f(n-1)\cdot I1+F(L-n+1)\cdot I2\}/4$ is calculated by means of multiplier generate circuits 405U and L and arithmetic circuits 411U and L within the active period of time. Alternatively, it is possible to perform the calculation in the CPU, write in the new values in the provided memory, read out as the address the outputs of the counters 403 and 404 and output the result a correcting signal on line 109.

Figure 9:
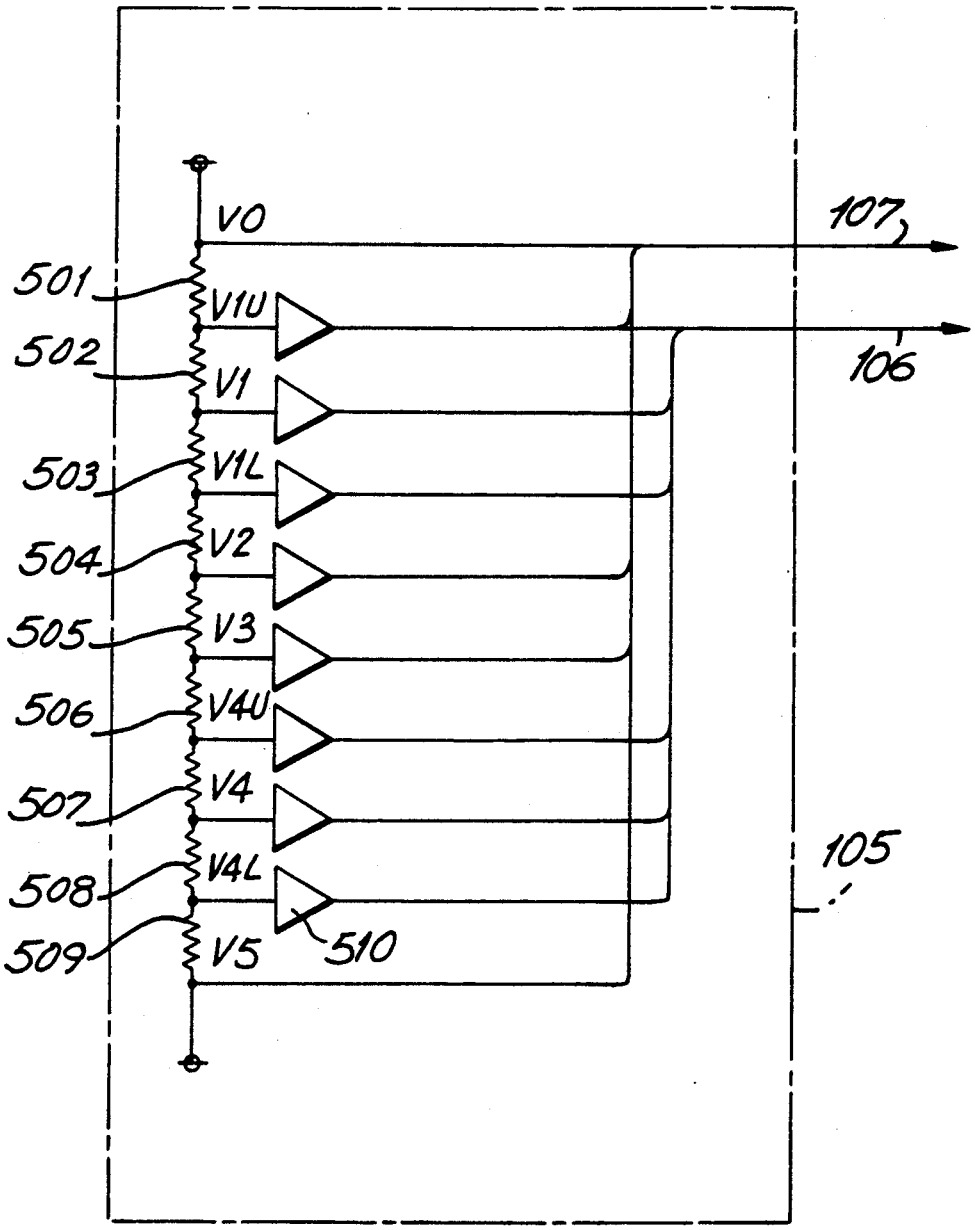
FIG. 9 is a circuit diagram of the power source circuit of FIG. 5.

Reference is now specifically had to FIG. 9 in which a circuit diagram of the voltage power circuit 105 is provided. A plurality of resistors 501 through 509 are serially connected and a voltage V0 and a voltage V5 are supplied at the ends of the series connection resistors, providing a series of voltage dividers thereby. The voltage drop across each resistor 501 through 509 is defined as V0, V1U, V1, V1L, V2, V3, V4U, V4, V4L and V5 respectively. From the upper side of FIG. 5 the following calculations can be made:

$$\begin{aligned} V &= V0 - V1 \\ &= V1 - V2 \\ &= V3 - V4 \\ &= V4 - V5 \end{aligned}$$

(wherein, V2−V3=a·V, and a is a constant value which is approximately in the range of 1 to 50).

The resistance value of each resistor 501 through 509 can be calculated with the following formulas:

$$V1U-V1=V4-V4L,$$

$$V1-V1L=V4U-V4.$$

A voltage stabilizing circuit 510 for stabilizing divided voltages V1U, V1, V1L, V2, V3, V4U, V4 and V4L formed by each resistors 501 through 509 is provided at the junction of the respective resistors. The voltage stabilizing circuit decreases the impedance of each voltage formed by the resistors 501 through 509 by holding the voltage. The voltage stabilization circuit may consist of a voltage follower circuit provided with an arithmetic amplifier circuit and emitter follower, formed by transistors.

The voltages V0, V1U, V1, V1L, V4U, V4, V4L, V5 are supplied to the liquid crystal unit 101 in FIG. 5 as the Y power source and the voltages V0, V2, V3 and V5 are supplied thereto as the X power source.

Dividing circuit 108 of FIG. 5 outputs the correcting clock signal on line 110, which forms a clock signal synchronized to the latch signal LP. The correcting clock signal on line 110 can be formed, for example, by dividing the signal XSCL, or it can be formed by a PLL circuit. The cycle of the correcting clock signal can be varied. For example it is possible to change the cycle provided it is synchronized with latch signal LP. The correction clock signals cycle can be obtained by experiment. In the present example, the correction clock signal is formed to have sixteen cycles within one cycle of signal LP.

Figure 10:
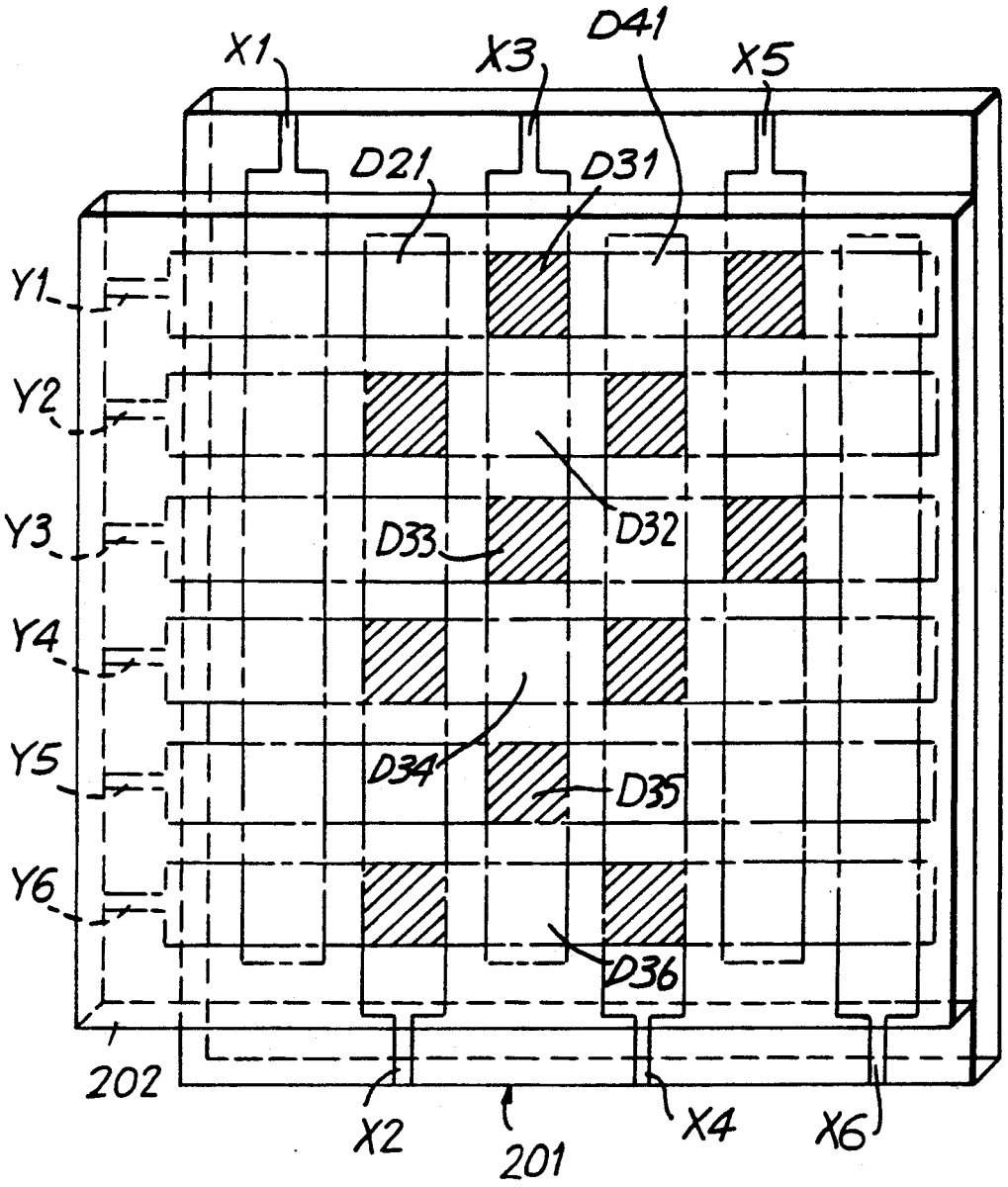
FIG. 10 is a schematic perspective view of a liquid crystal panel showing an example of a displayed pattern.
Figure 11A:
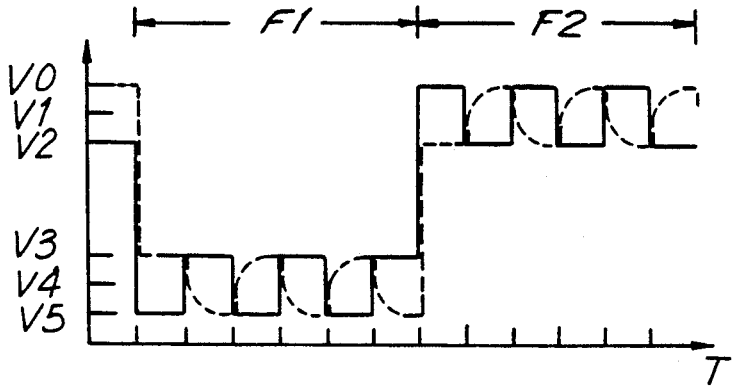
FIGS. 11(*a*)-(*g*) are waveform diagrams showing an example of the voltage waveform applied to the liquid crystal panel, which results in the displayed pattern of FIG. 10.
Figure 11B:
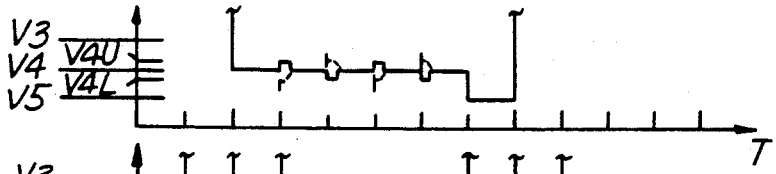
Figure 11C:
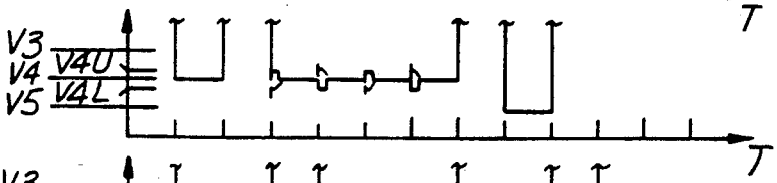
Figure 11D:
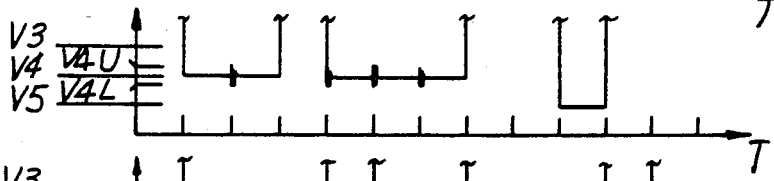
Figure 11E:
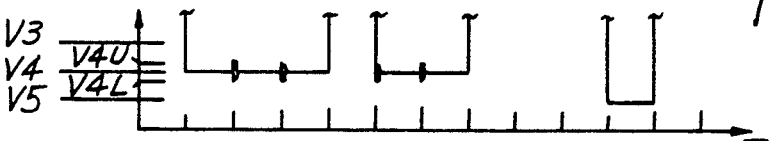
Figure 11F:
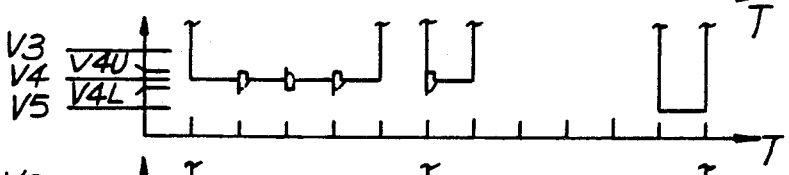
Figure 11G:
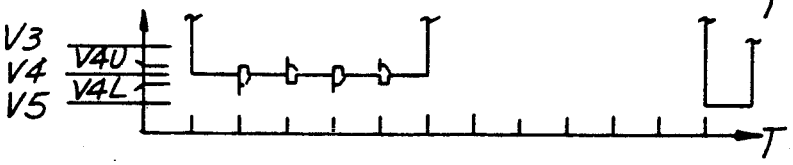

With particular reference to FIG. 10 a checkered display pattern is depicted, wherein the display elements containing hatching show the lighting condition. An example of the operation of correcting circuit 10 will be described in connection with the display pattern of FIG. 10. Correcting circuit 104 of FIG. 5 separately counts the number $M1_{ON}$ which indicates the number of lighting display elements formed by the intersection of scanning electrode Yn+1 and signal electrodes X1, X3 and X5. These signal electrodes all have their driving end on the upper side of the liquid crystal display 1. Alternatively, $M2_{ON}$ indicates the number of lighting display elements formed by the intersection of scanning electrode Yn+1 and signal electrodes X2, X4 and X6. These signal electrodes all have their driving end on the lower side of liquid crystal display 1.

Secondly the value $N1_{ON}$ is calculated. $N1_{ON}$ represents the number of lighting display dots formed by the intersection of scanning electrode Yn and signal electrodes X1, X3 and X5 having their driving end on the upper side of the display 1. $N2_{ON}$ indicates the number of intersections of scanning electrode Yn with signal electrodes X2, X4 and X6, having their driving end on the lower portion of liquid crystal display 1.

Next the values of Il and I2 are calculated as the respective difference between $N1_{ON}$ and $M1_{ON}$ and the difference between $N2_{ON}$ and $M2_{ON}$. The values $N1_{ON}$ and $N2_{ON}$ are held in latch circuit 407U and L shown in FIG. 8 which is part of correcting circuit 104. Thus the calculation of Il and I2 are as follows:

$$I1 = N1_{ON} - M1_{ON}$$

$$I2 = N2_{ON} - M2_{ON}$$

Thus, this calculation is completed in arithmetic circuit 408U and L, and it is written into the address of n−1 in memory 409U and L. This process is repeated from n=1 to n=5 and from n=5 to n=0 Thus, the difference I1 and I2 corresponding to all scanning electrodes Y1 through Y6 are written in memory 409U and L. In the example of the display as shown in FIG. 10, −2, 2, −2, 2, −2, 2, would be written in memory 409U for the addresses 0 to 5, and 2, −2, 2, −2, 2, −2 would be written in the memory 409L.

The arithmetic function, $f(k-1)\cdot I1 + f(L-k+1)\cdot I2$ (wherein k=1, 2, . . . 6) is carried out for the values I1 and I2 of the address n−1 in memory 409U and L and parallel to the writing operation to 409U and L, and the results are sequentially transferred to shift register circuit 207 in Y driver of FIG. 6.

For example, the values −2 and 2 are read out of memory 409U and L from the appropriate address such as, when n=3, n−1=2. Thus, the calculations are carried out and the result is taken to shift register 207 prior to scanning electrode Yn+1 being selected. An example of a set of such calculations is as follows:

$$\begin{aligned} I &= \{f(0)\cdot I1 + f(5)\cdot I2\}/4 \\ &= \{15\cdot(-2) + 10\cdot 2\}/4 \\ &\approx -3 \end{aligned}$$

$$\begin{aligned} I &= \{f(1)\cdot I1 + f(4)\cdot I2\}/4 \\ &= \{14\cdot(-2) + 11\cdot 2\}/4 \\ &\approx -2 \end{aligned}$$

$$\begin{aligned} I &= \{f(2)\cdot I1 + f(3)\cdot I2\}/4 \\ &= \{13\cdot(-2) + 12\cdot 2\}/4 \\ &\approx -1 \end{aligned}$$

$$\begin{aligned} I &= \{f(3)\cdot I1 + f(2)\cdot I2\}/4 \\ &= \{12\cdot(-2) + 13\cdot 2\}/4 \\ &\approx 1 \end{aligned}$$

$$\begin{aligned} I &= \{f(4)\cdot I1 + f(1)\cdot I2\}/4 \\ &= \{11\cdot(-2) + 14\cdot 2\}/4 \\ &\approx 2 \end{aligned}$$

$$\begin{aligned} I &= \{f(5)\cdot I1 + f(0)\cdot I2\}/4 \\ &= \{10\cdot(-2) + 15\cdot 2\}/4 \\ &\approx 3 \end{aligned}$$

Any fractions that result from the above calculations are rounded to the nearest whole number.

The above mentioned values are transmitted to latch circuit 208 simultaneously with scanning electrode Yn+1 being selected during the leading edge of latch signal LP. Simultaneously counter 209 is reset to 0. Counter 209 is then counted up by the correcting clock signal on line 110.

In our example we were working with n=3, thus the next selected scanning electrode Yn+1 becomes scanning electrode Y4, therefore, each switch of level shifter circuit 212 selects S4 (correcting voltage (L)), S2 (correcting voltage (U)), S4 (correcting voltage (L)), S1 (selective voltage), S4 (correcting voltage (L)) and S2 (correcting voltage (U)) as the output to each scanning electrode Y1 through Y6 of the liquid crystal panel 1.

As the correcting clock signal on line 110 is input into counter circuit 209 each switch selecting S2 or S4 continues in that state until the count in counter circuit 209 equals the number stored in the corresponded latch circuit 208 (representative of intensity signal I0–I3, the results of the above calculations). When the output of the counter circuit 209 coincides with the number indicated by each corresponding latch circuit 208, each switch selects S3 (non-selective voltage) to output. Thus, the direction of application of the correcting voltage (U) or (L) depends upon the numerical value I, which can be positive or negative. The correcting voltage is selected instead of non-selective voltage for as long a period of time as the absolute value of I.

Scanning electrodes Y1 through Y6 of liquid crystal panel 1 can be supplied with the voltages as described above.

X driver 213 supplies the lighting voltage to the display elements 7 to be in its lighting state formed by each signal electrode X1 through X6 intersecting with selected scanning electrode Yn+1 and supplies the non-lighting voltage to the signal electrode if the display element is not lighting.

Reference is now made to FIGS. 11 (*a*) through (*g*) in which the voltage waveforms added to scanning electrodes Y1 through Y6 and signal electrodes X1 through X6 of the liquid crystal display panel 1 of FIG. 10 are shown. The full line of waveform shown in FIG. 11 (*a*) depicts the voltage wave of signal electrodes X3 and X5 in the position of lighted display elements D31 and D51 shown in FIG. 10, and the broken line shows the voltage waveform of signal electrodes X2 and X4 in the position of unlighted display elements D21 and D41. The full line shown in FIG. 11(*b*) depicts the voltage waveform applied to the scanning electrode Y1, and the broken line depicts the turbulence of the waveforms which is generated in the position of display element D31 of scanning electrode Y1. Similarly, FIG. 11 (*c*), depicts the voltage waveform applied to scanning electrode Y1 and the turbulence generated in the waveform in the position of display element D32. FIG. 11 (*d*) depicts the voltage waveform applied to scanning electrode Y1 and the turbulence created on the waveform generated in the position of display element D33. FIG. 11 (*e*) depicts the voltage waveform applied to scanning electrode Y1 and the turbulence occurring upon the waveform that is generated in the position of display element D34. FIG. 11 (*f*) depicts the voltage waveform applied to operating electrode Y1 and the turbulence created upon the waveform generated in the position of display element D35. FIG. 11 (*g*) depicts the voltage waveform applied to scanning electrode Y1 and the turbulence created upon the waveform that is generated in the position of display element D36.

Upon review of the drawings, it is revealed that the variation in the voltage wave of signal electrodes X3 and X5 shown in full line in FIG. 11 (*a*) has the effect of creating turbulence upon scanning electrodes Y1, Y2 and Y3 all of which are positioned on the upper side of liquid crystal display 1. The turbulence is greatest upon scanning electrode Y1, and incrementally decreases as lower scanning electrodes Y2 and Y3. Similarly, the variations in voltage waveforms of signal electrodes X2 and X4 which have their driving end of the lower side of liquid crystal display 1 have an effect on scanning electrodes Y6, Y5 and Y4 positioned on the lower side of liquid crystal display 1. In this case the effect is greatest at scanning electrode Y6 and varies in a decreasing manner incrementally to scattering electrodes Y5 and Y4.

Thus, to counteract the turbulence generated as depicted in waveform of FIGS. 11 (*b*) through (*g*) upon scanning electrodes Y1 through Y6, the Y driver 205 of FIG. 6 outputs the correcting voltage (U) or (L) in the reverse direction to the turbulence generated in each scanning electrode Y1 through Y6 in place of the non-selective voltage. Further, the time of output is increased or decreased in accordance with the degree of turbulence generated upon each waveform of scanning electrodes Y1 through Y6. The correcting voltage is supplied for a long period of time where there is large turbulence, and the correcting voltage is supplied for a short period of time where there is small turbulence. After the turbulence has dissipated the non-selective voltage is supplied.

The turbulence generated upon each waveform of each scanning electrode Y1 through Y6 is substantially reduced through the use of the correcting voltage. Thus, the differences in effective voltages supplied to each display element of the liquid crystal panel is reduced, thereby, solving one of the causes of unevenness of display.

As hereinbefore described by calculating the difference between the number of lighting display elements on a selected scanning electrode and the number of lighting display elements on the scanning electrode following the selected scanning electrode, and adding consideration for the position of the selected scanning electrode and its proximity to the driving end of the signal electrodes, the correcting voltage to be added is thereby calculated. Furthermore, the amount of correcting voltage added to the scanning electrode is adjusted on the basis of the obtained difference, and is varied in each and every electrode, thereby, reducing the unevenness of display.

Embodiment 2

In the first embodiment, a liquid crystal panel is described in which the signal electrodes receive their signal voltage wave alternatively from the upper and lower sides. It is possible to provide a liquid crystal display with reduced unevenness of display wherein the signal electrodes of the liquid crystal display receive their signal electrode voltage from only one side. For example, the case in which the signal voltage wave is supplied from the upper side of the liquid crystal display is considered. Thus, the signal "1" is supplied to gate circuit 402U at all times instead of the output of T−F/F 401 of FIG. 8. Thus, only one half of the circuits would be necessary, and the other circuits are all unnecessary. Thus, gate circuit 402L and the circuits 405L, and 406L through 41OL are accordingly no longer necessary, and circuit 412 can be omitted because the input from 411L becomes 0 at all times. Thus, the output of correcting circuit 104 would be the output of arithmetic circuit 411U. Thus, the numerical value I is calculated as follows:

$$I=(I1+I2)\cdot f(k)$$

Accordingly, similar effects are obtained when the circuit is operated similarly to that of the first embodiment on the basis of the value I.

Embodiment 3

The first and second embodiments describe a liquid crystal panel in which the signal voltage wave is applied only from one portion of the signal electrode. Alternatively, the effect of supplying a signal voltage wave from both sides of the signal electrode can be obtained.

The value "I" can be calculated by substituting the function g({k−L/2{) for the function (k) of Example 1. The function g(x) is a function that increases as the value x becomes larger.

By operating the circuit of Example 3 similar to that of Example 1 in accordance with the value I, similar results will occur in both examples.

The first and third embodiments use a method for adjusting the correcting amount in which the difference between the correcting voltage and the non-selective voltage is constant and the time period for applying the correcting voltage is varied (hereinafter referred to as "time access correction"). Alternatively, it is possible to vary the difference between the correcting voltage and the non-selective voltage, holding the correcting time constant (hereinafter referred to as "voltage access correction"). Furthermore, it is possible to vary both the time in which the correcting voltage is applied and the difference between the correcting voltage and non-selective voltage (hereinafter referred to as "time-voltage access correction"). Further, the correction voltage may be defined having a waveform which is defined by an exponential function or a side of a triangle, and having wave height value varying in accordance with the required correction amount. (hereinafter referred to as "function waveform correction").

Embodiment 4

This embodiment deals with the unevenness of display caused by weft pulling.

The unevenness of display generated by weft pulling in the degree corresponding to the value Z' is calculated by the following formula:

$$Z' = \sum_{i=1}^{6} q(i)\cdot\delta(i)$$

The position of each display element is at the intersection of each scanning electrode Y1 through Ys and each signal electrode Xp (p=1, 2, . . ., r). Thus, the effective voltage applied to each display element on the scanning electrode decreases in accordance with the value Z'. The correction can be carried out by calculating the value Z' and correcting in accordance with that value Z' during the operation of the liquid crystal display device.

Reference is made to FIGS. 12–15, wherein the structure of a correcting circuit that corrects weft pulling is depicted. Control signal circuit 102 and data signal circuit 103 of FIG. 12 operate the same as control signal circuit 102 and data signal circuit 103 of FIG. 5. The explanation of devices represented by like reference numerals as in the first embodiment will be omitted.

Liquid crystal unit 801 is provided with liquid crystal panel 1, scanning electrode driving circuit 805 and signal electrode driving circuit 213. Voltage wave correcting circuit 804 (hereinafter referred to as "correcting circuit") calculates the value Z' and generates the correcting signal on line 809. The correcting signal on line 809 becomes active during the time period corresponding to the obtained value. Power source circuit 805 feeds a Y power source voltage wave on line 806 (hereinafter referred to as "Y power source"). Y power source line 806 receives the correcting voltages, selective voltages and non-selective voltages and outputs these voltages to two pairs of scanning electrodes, thus driving the scanning electrode output. Power source circuit 805 outputs as the Y power source on line 806 the different correcting voltage or selective voltage when the correcting voltage signal on line 809 is active or non-active. Power source circuit 805 feeds an X power source signal to line 807 (hereinafter referred to as X power source) and transmits power to two pairs of signal electrodes transmitting enough power to the drive the signal electrodes. The X power source signal on line 807 of FIG. 12 operates in a similar fashion to the X power source signal on line 107 of FIG. 5.

Figure 12:
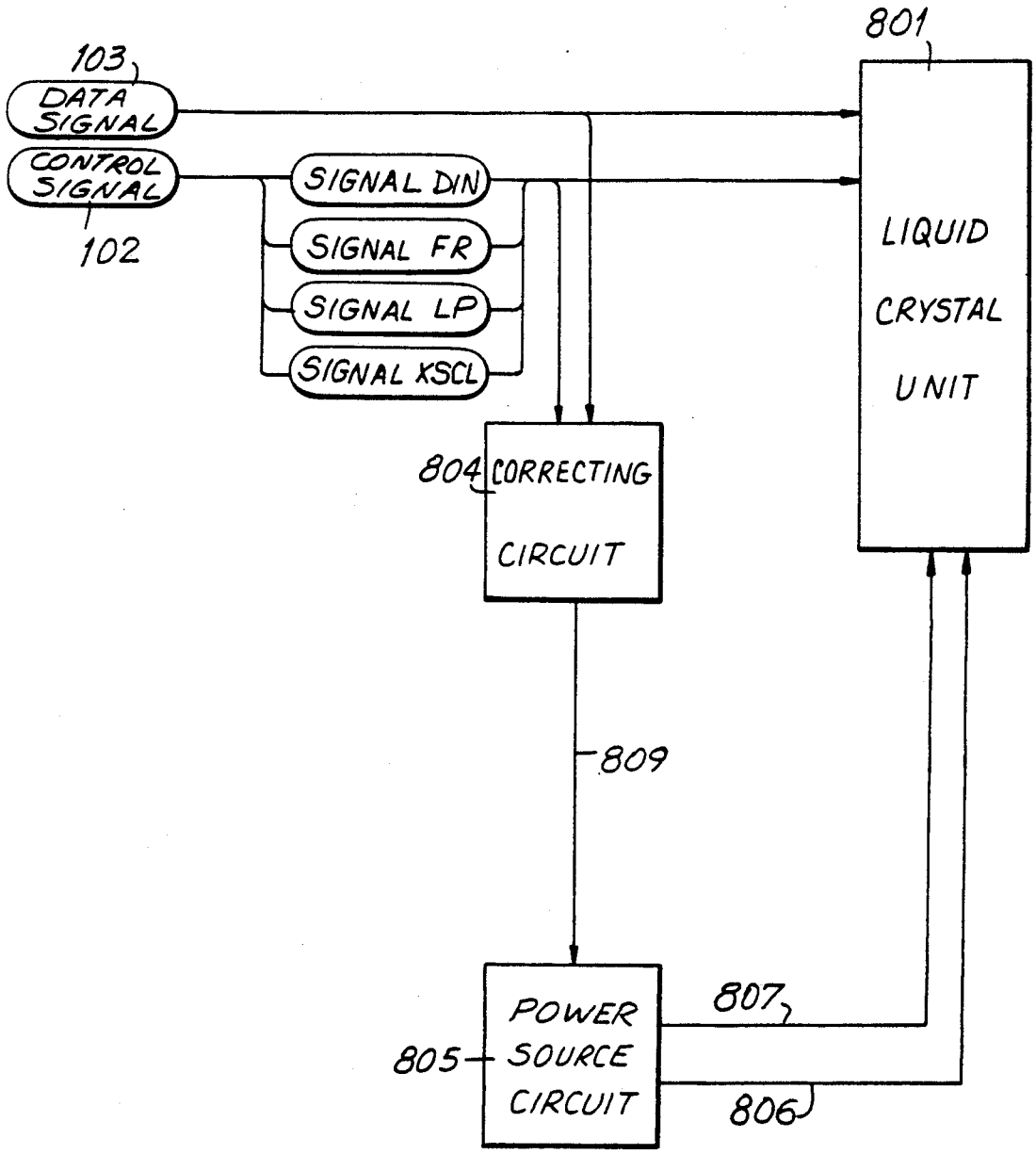
FIG. 12 is a block diagram of the fourth embodiment of the liquid crystal display device of the present invention.
Figure 13:
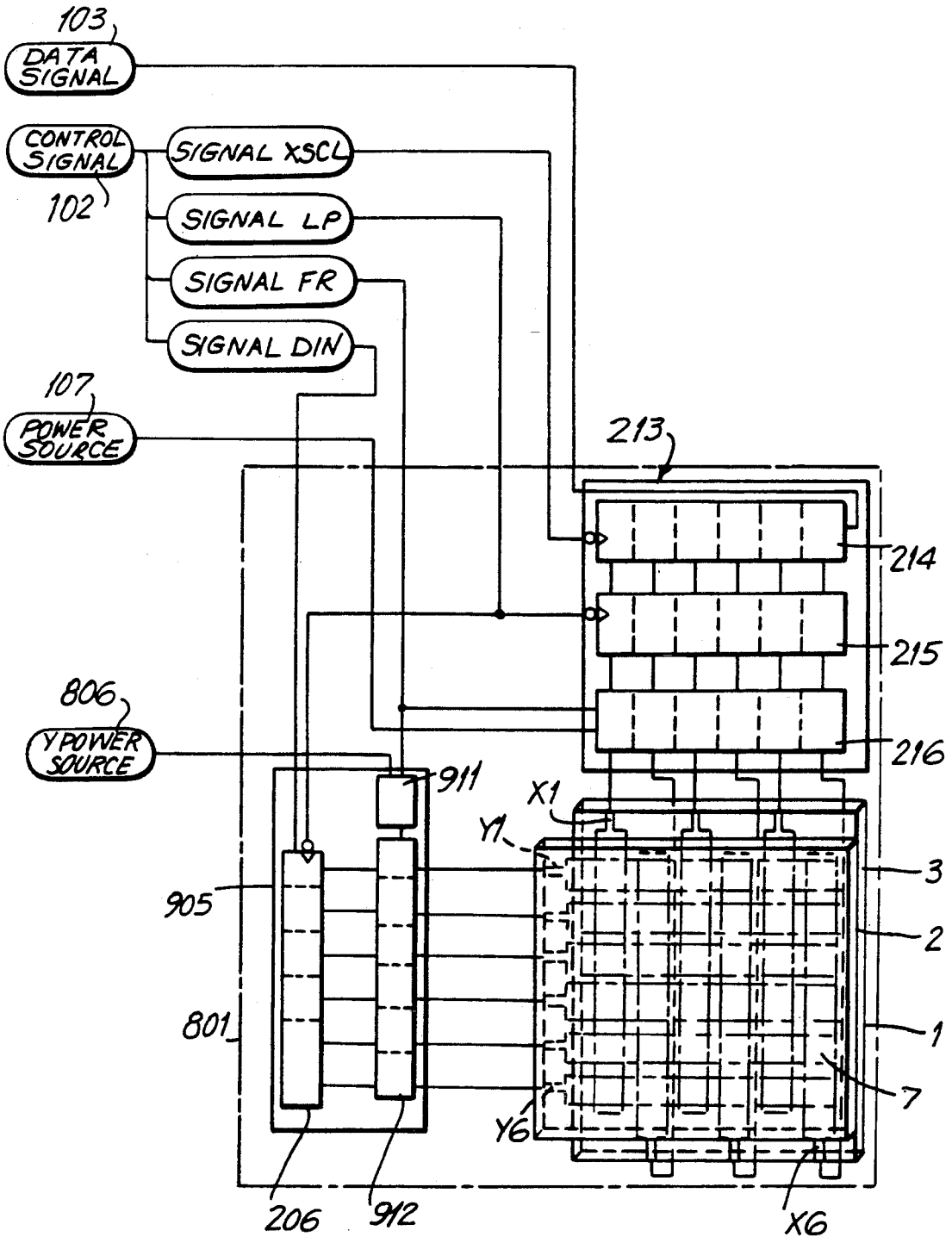
FIG. 13 is a block diagram and schematic view of the liquid crystal unit of FIG. 12.

Reference is now made to FIG. 13, wherein a concrete example of the structure of liquid crystal unit 801 is depicted Liquid crystal panel 1 is similar to that of the first embodiment. Scanning electrode driving circuit 805 (hereinafter referred to as "Y driver") is provided with shift register 206, switch circuit 911 and level shifter circuit 912. The outputs of level shifter circuit 912 are lead into the corresponding scanning electrodes Y1 through Y6 of liquid crystal panel 1. Shift register circuit 206 is similar to that of the first embodiment and a description thereof is omitted. Switching circuit 911 selects one pair of the two pairs of voltages transmitted by Y power source line 806 output from power source circuit 805 shown in FIG. 12, according to the frame signal FR.

Switching circuit 911 divides the voltages V0', V1, V4 and V5' of Y power source line 806 into a first voltage group consisting of V0' and V4, and a second voltage group consisting of V5' and V1. Switching circuit 911 chooses either the first voltage group or the second voltage group according to the frame signal FR. The voltages V0' and V4 are the selective voltage and non-selective voltage respectively of the first group. Similarly, the voltages V5' and V1 are the selective and non-selective voltage respectively of the second voltage group. Regardless of which voltage group is selected the appropriate voltage group is output from switching circuit 911 and input into level shifter circuit 912.

Level shifter circuit 912 is provided with a plurality of switches each having two input circuits and one connecting point, and is switched according to the contents of a corresponding register of shift register 206.

When the contents of a register of shift register 206 is "1", each switch selects the selective voltage to be output to each corresponding scanning electrode Y1 through Y6. Alternatively, when the contents of a register of shift register 206 is "0" each switch selects the non-selective voltage t be output to each corresponding scanning electrode Y1 through Y6.

The structure of Y driver circuit 905 is described above. Y driver 905 operates by inputting data-in signal DIN into shift register 206 in sync with latch signal LP. Shift register 206 then outputs the selective voltage to one switch of level shifter circuit 912. Shift register 206 outputs the selective voltage sequentially to each switch of level shifter circuit 912. This results in the selective voltage being sequentially rotated to each Y electrode Y1 through Y6. The X driver circuit 213 is similar to that of the first embodiment and its explanation is omitted.

The liquid crystal unit 801 is synchronized by the data-in signal DIN and latch signal LP. Scanning electrodes Y1 through Y6 are sequentially applied with the selective voltage. The lighting or non-lighting voltage corresponding to the display pattern is added to the appropriate signal electrodes X1 through X6 in sync therewith, to provide a display on liquid crystal panel 1.

Correcting circuit 804 of FIG. 12 calculates the following formula:

$$Z' = \sum_{i=1}^{6} q(i) \cdot \delta(i)$$

i represents the position of the display element formed by the intersection of signal electrode Xp (p=1, 2, . . ., 6) and scanning electrodes Y1 through Y6 which is applied with the selective voltage. The value Z' determines the length of time for correcting signal 809 to be output in syn with latch signal LP upon the application of the selected voltage to the following scanning electrode.

Figure 14:
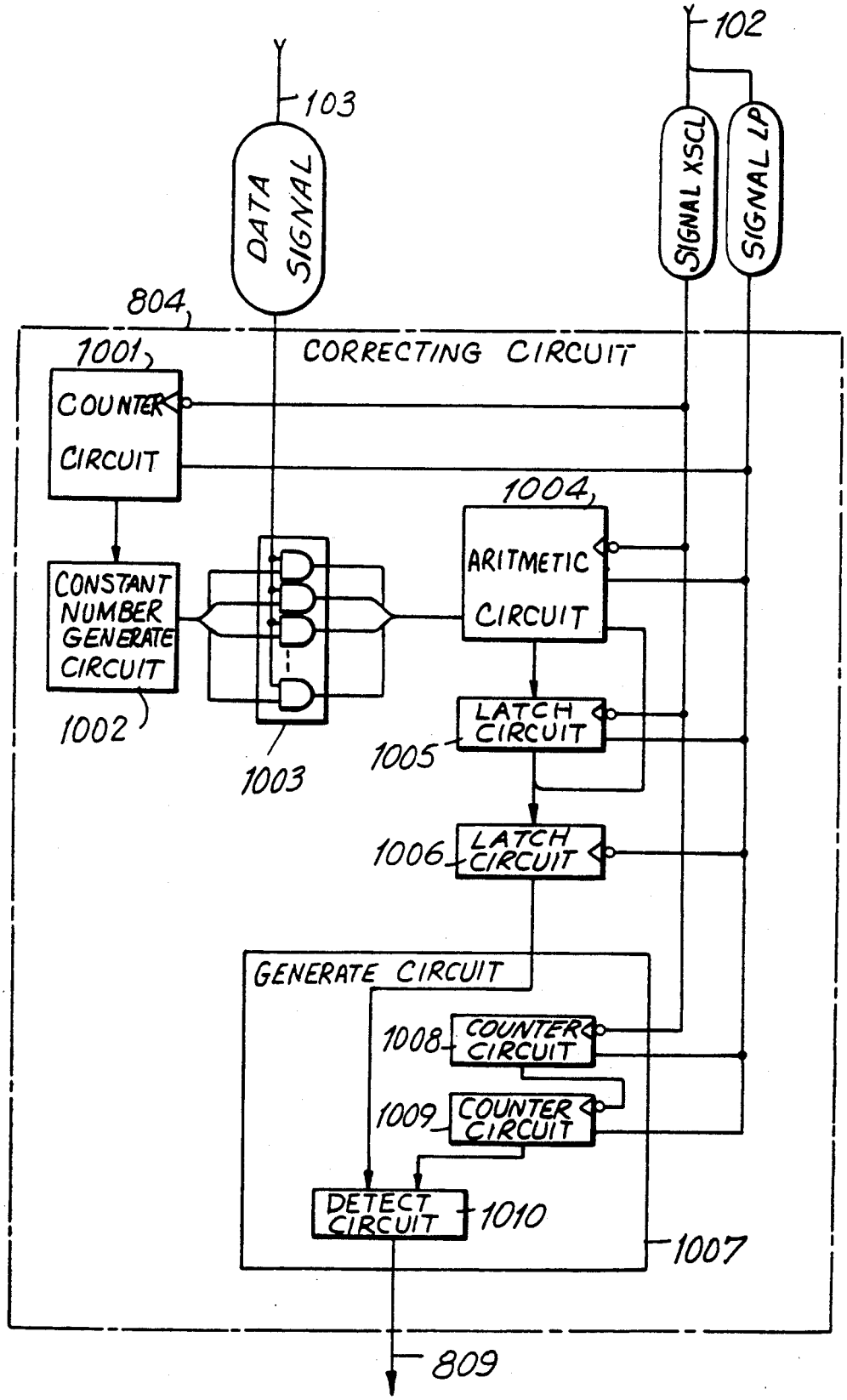
FIG. 14 is a block diagram of the correcting circuit of FIG. 12.

Reference is next made to FIG. 14 wherein a block diagram of a correcting circuit is depicted, including counter circuit 1001, constant number generate circuit 1002, gate circuit 1003 which takes the logical multiple of each output of a plurality of signals indicating the value output from the constant number generate circuit 1002 and the data signal from data signal circuit 103, arithmetic circuit 1004 for carrying out addition, first latch circuit 1005 for holding the result of arithmetic circuit 1004, second latch circuit 1006, and correcting signal generate circuit 1007 for generating a correcting signal on line 809 for a time period corresponding to the subject of the second latch circuit 1006 in sync with latch signal LP (hereinafter referred to as "generate circuit").

Counter circuit 1001 is a counter which is reset to 0 by latch signal LP and counts up according to the pulse supplied by signal XSCL. The output of counter 1001 is input into constant number generate circuit 1002.

Constant number generate circuit 1002 is provided with a ROM and the diode matrix, which outputs different values in accordance with the output of counter circuit 1001. Accordingly, it outputs a larger value as the output of counter circuit 1001 becomes larger. This corresponds to the function q(i) of the above formula. The value i is obtained by adding 1 to the value output from counter circuit 1001.

The value of the function can be obtained by experiment, and it is defined simply in the present example as follows:

i=1, q(1)=1 i=2, q(2)=1.1 i=3, q(3)=1.2 i=4, q(4)=1.3 i=5, q(5)=1.4 i=6, q(6)=1.5

Gate circuit 1003 generates the logical multiple of the value output from constant number generate circuit 1002 and data signal circuit 103. It outputs the value of the constant number generate circuit 1002 as it is when the data signal is active "1", and it outputs 0 when the data signal is non-active at the trailing edge of the signal XSCL. This corresponds to q(i)19 δ(i) of the above formula, wherein, i designates the position of the display element formed by the scanning electrode and each signal electrode, and it is equal to the value obtained by adding 1 to the value output from counter 1001.

Arithmetic circuit 1004 adds the value output from gate circuit 1003 to the contents of first latch circuit 1005 in sync with signal XSCL, and returns the result into first latch circuit 1005.

First latch circuit 1005 holds the result from arithmetic circuit 1004, and is reset to 0 by latch signal LP. The value of the first latch circuit 1005 approximately before it is reset, corresponds to the value Z' in the formula:

$$Z' = \sum_{i=1}^{6} q(i) \cdot \delta(i)$$

The number of lighting display elements on the next scanning electrode to be applied with the selected voltage is counted with consideration given to the proximity of the lighting dot to the driving end of the electrode.

The output of first latch circuit 1005 is input into second latch circuit 1006 approximately before first latch circuit is reset at the trailing edge of latch signal LP. Since the next scanning electrode is selected at the trailing edge of the latch signal LP, the value indicated by the second latch circuit 1006 represents the number of lighting display elements with the weight on the selected scanning electrode.

Generate circuit 1007 outputs a correcting signal on line 809 as active "1" for a period of time corresponding to the value indicated by the second latch circuit 1006. For example, generate circuit 1007 includes a first counter circuit 1008 which receives signal XSCL as the clock (hereinafter referred to as "correcting clock"), which is divided or doubled. The output of first counter circuit 1008 is input into second counter circuit 1009. First counter circuit 1008 and second counter circuit 1009 are reset to 0 by latch signal LP. Coincidence detect circuit 1010 generates the active "1" signal until the value indicated by the output of second counter circuit 1009 coincides with the value indicated by second latch circuit 1006. The interval of the cycle of the correcting clock is not necessarily constant, but can be determined, for example, by experiment.

Since the correcting circuit is structured as described above, the number of lighting display elements on the following scanning electrode is counted and weighted for the distance from the end thereof to which the scanning voltage wave is applied, and the correcting signal on line 809 is active "1" for a length of time corresponding to the value Z' and is synchronized with the latch signal LP when the following selected scanning electrode is selected.

Figure 15:
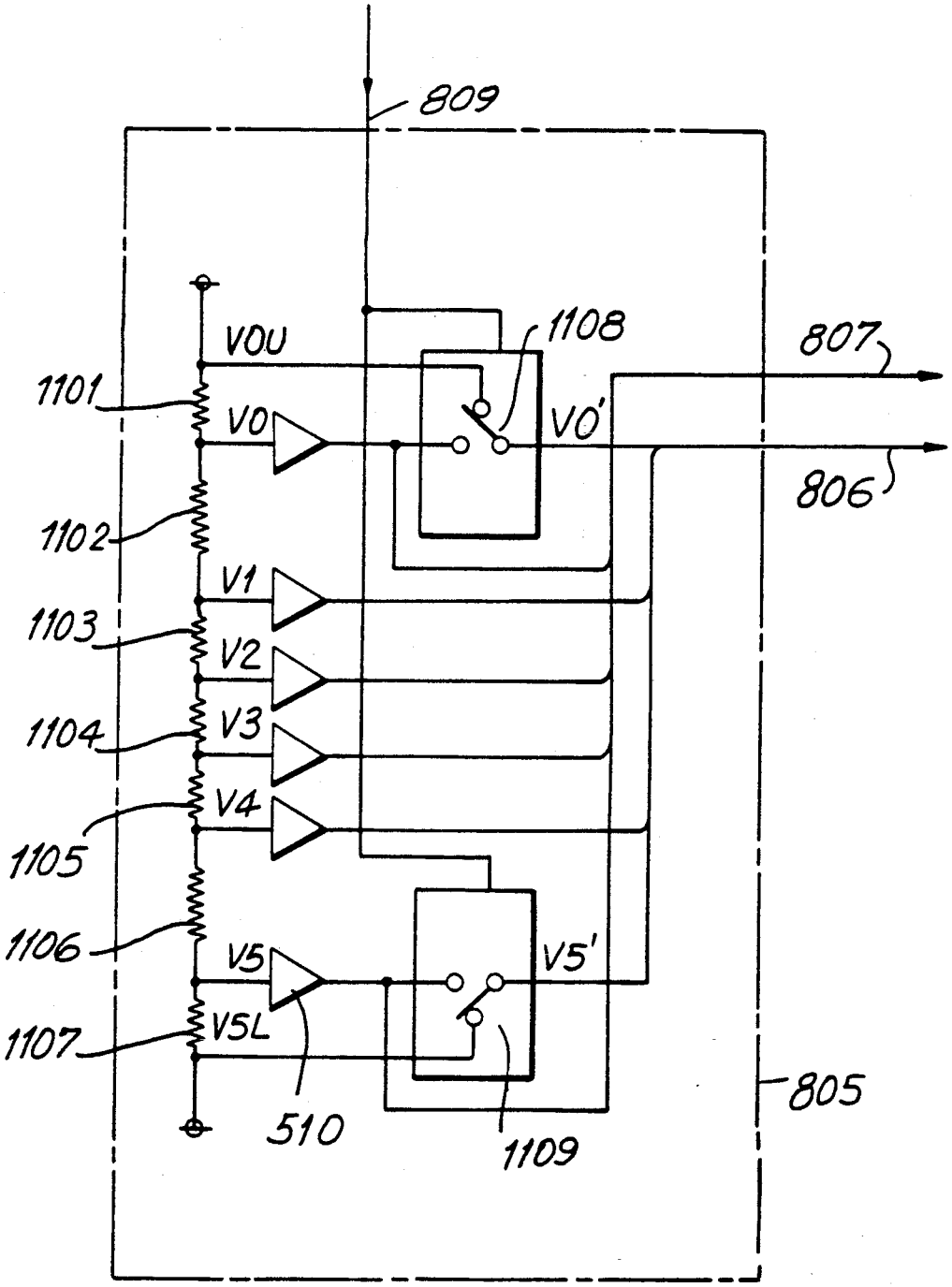
FIG. 15 is a circuit diagram of the power source circuit of FIG. 12.

Reference is made to FIG. 15, wherein power source circuit 805 of FIG. 12 is depicted. Power source circuit 805 is provided with a plurality of resistors 1101 through 1107 which are serially connected and a voltage V0U and a voltage V5L are supplied at the ends of the series-connected resistors, providing a series of voltage dividers thereby. The voltage at the end of each resistor 1101 through 1107 is respectively defined as V0U, V0, V1, V2, V3, V4, V5 and V5L, from the upper side. Thus, the following equations can be obtained.

$$\begin{aligned} V &= V0 - V1 \\ &= V1 - V2 \\ &= V3 - V4 \\ &= V4 - V5 \end{aligned}$$

The value V2−V3=a·V, wherein a is a constant number which is in the range of about 1 through 50.

The resistance value of each resistor 1101 through 1107 is set to be obtained by the following formula:

$$V0U - V0 = V5 - V5L$$

Voltage stabilizing circuit 510 is similar to that of the first embodiment so that the explanation thereof is omitted.

Switch circuits 1108 and 1109 select the voltage V0U when correcting circuit 809 is active "1" and select the voltage V0 when correcting circuit 809 is non-active "0". The selected voltage is defined as the voltage VO". Similarly, switch 1109 selects the voltage V5L when the correcting signal 809 is active "1" and selects the voltage V5 when the correcting signal 809 is non-active "0". The selective voltage is defined as the voltage V5'. The voltages V0U and V5L are known as the correcting voltages.

In the structure as described above, the voltages V0', V4, V5' and V1 are supplied to the liquid crystal unit 801 shown in FIG. 12 as the Y power source signal on line 806, and the voltages V0, V2, V3 and V5 are supplied thereto as the X power source signal on line 807.

The structure of the liquid crystal display device shown in FIG. 12 is as described above.

Figure 3:
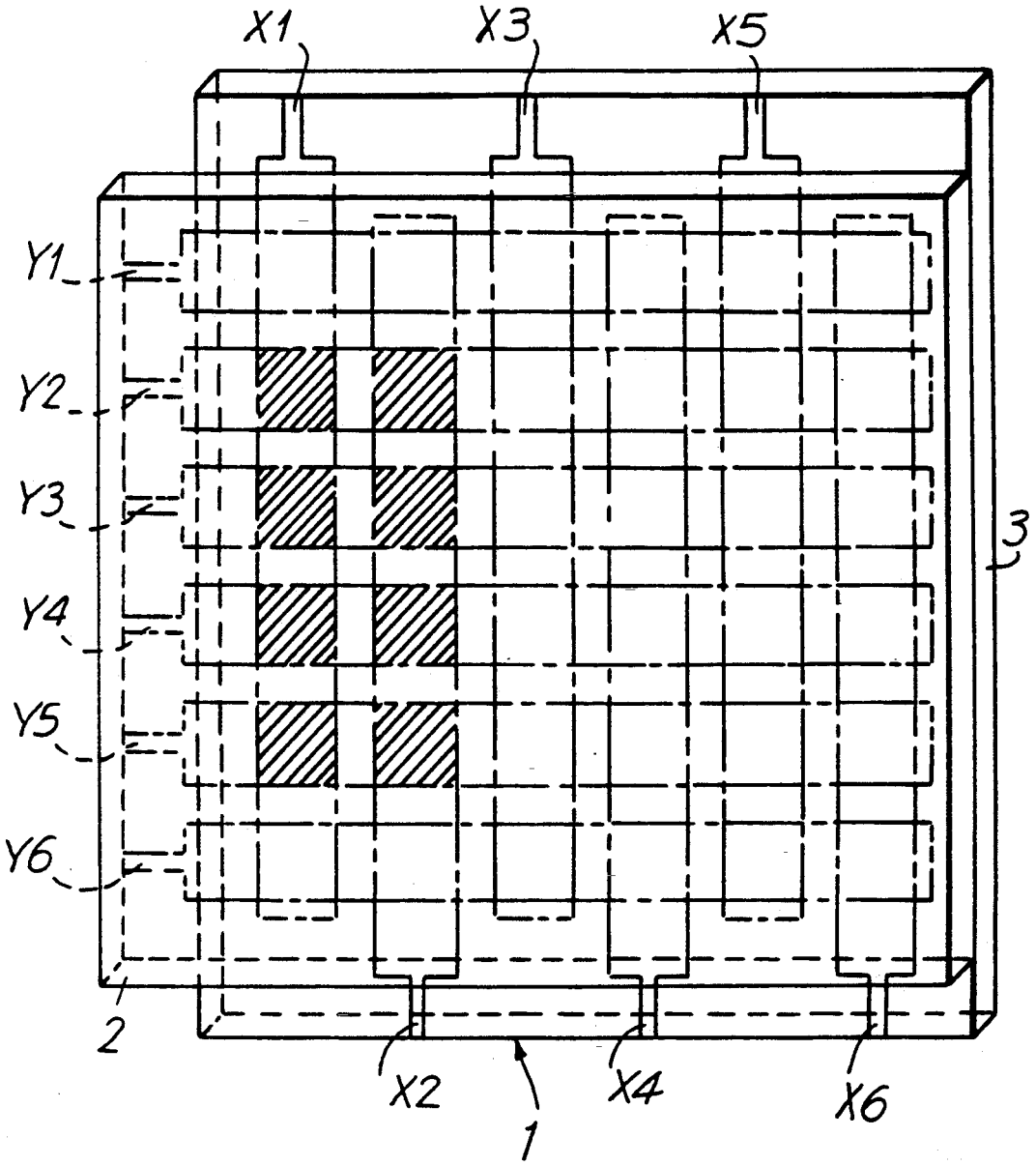
FIG. 3 is a schematic perspective view of the liquid crystal panel showing another example of a displayed pattern.
Figure 4:
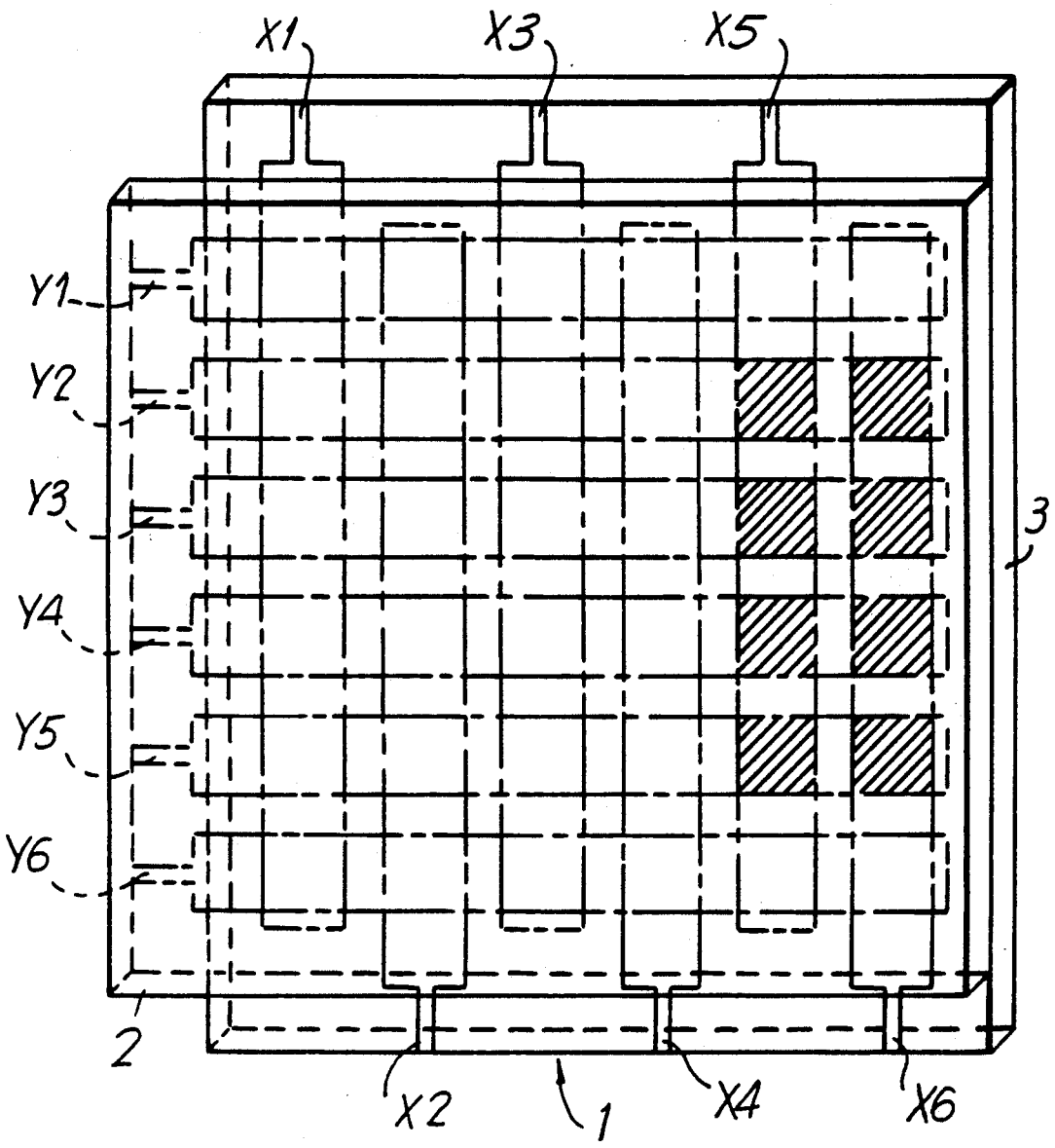
FIG. 4 is a schematic perspective view of the liquid crystal panel showing still another example of a displayed pattern.

Reference is made to FIG. 3 and FIG. 4, wherein an example of the operation of the liquid crystal panel 1 of FIG. 13 is shown displaying particular patterns. In FIGS. 3 and 4 the display dots with hatching show the lighting condition, and similar quadrangle display patterns are shown in both FIG. 3 and FIG. 4, but one is shifted to the left, and the other is shifted to the right. When the display of FIG. 3 and FIG. 4 is displayed, the correcting circuit 804 of FIG. 12 counts the number of lighting display elements on each scanning electrode Y1 through Y6 of the liquid crystal panel 1 in FIG. 3 or FIG. 4 with weight given to the position of the lighting display element, namely, the value Z' is obtained. The value Z' for each scanning electrode Y1 through Y6 is as follows.

When the display of FIG. 3 is shown, the following values are obtained:

scanning electrode Y1 - - - - -

$$\begin{aligned} Z' &= 0 + 0 + 0 + 0 + 0 + 0 \\ &= 0 \end{aligned}$$

scanning electrode Y2 - - - - -

$$\begin{aligned} Z' &= 1.0 \cdot 1 + 1.1 \cdot 1 + 0 + 0 + 0 + 0 \\ &= 2.1 \end{aligned}$$

scanning electrode Y3 - - - - -

-continued $$Z' = 1.0 \cdot 1 + 1.1 \cdot 1 + 0 + 0 + 0 + 0 = 2.1$$

scanning electrode Y4 - - - - -

$$Z' = 1.0 \cdot 1 + 1.1 \cdot 1 + 0 + 0 + 0 + 0 = 2.1$$

scanning electrode Y5 - - - - -

$$Z' = 1.0 \cdot 1 + 1.1 \cdot 1 + 0 + 0 + 0 + 0 = 2.1$$

scanning electrode Y6 - - - - -

$$Z' = 0 + 0 + 0 + 0 + 0 + 0 = 0$$

When the display of FIG. 4 is shown, the following values are obtained:

scanning electrode Y1 - - - - -

$$Z' = 0 + 0 + 0 + 0 + 0 + 0 = 0$$

scanning electrode Y2 - - - - -

$$Z' = 0 + 0 + 0 + 0 + 0 + 1.4 \cdot 1 + 1.5 \cdot 1 = 2.9$$

scanning electrode Y3 - - - - -

$$Z' = 0 + 0 + 0 + 0 + 0 + 1.4 \cdot 1 + 1.5 \cdot 1 = 2.9$$

scanning electrode Y4 - - - - -

$$Z' = 0 + 0 + 0 + 0 + 0 + 1.4 \cdot 1 + 1.5 \cdot 1 = 2.9$$

scanning electrode Y5 - - - - -

$$Z' = 0 + 0 + 0 + 0 + 0 + 1.4 \cdot 1 + 1.5 \cdot 1 = 2.9$$

scanning electrode Y6 - - - - -

$$Z' = 0 + 0 + 0 + 0 + 0 + 0 = 0$$

Thus, correcting circuit 804 of FIG. 12 outputs the active correcting signal on line 809 for a period of time corresponding to the value Z'.

Accordingly, power source circuit 805 outputs the correcting voltages V0U and V5L instead of the voltages V0 and V5 as the selective voltages for the period of time in which the correcting signal on line 809 is active.

The value Z' for the scanning electrodes Y2 through Y5 is smaller when the display of FIG. 3 is displayed, and is larger when the display of FIG. 4 is displayed. Therefore, the time period in which the correcting voltage V0U and V5L are added is shorter for the display of FIG. 3, and is larger for the display of FIG. 4. Y driver 905 sequentially adds the selective voltage to each scanning electrode Y1 through Y6 by using the selective voltage varying in accordance with the value Z'.

Since the operation of X driver 213 is similar to that of the first embodiment, the explanation is omitted.

In carrying out the above mentioned operations, as shown in the example of FIG. 3, a selective voltage having a smaller value of correcting voltage is supplied to the selective scanning electrode. This is due to the fact that the rounding of the voltage wave on the scanning electrode is small when the lighting dot is positioned proximately to the driving end of the scanning electrode with regard to scanning electrodes Y2 through Y5. Accordingly, the correcting voltages V0U and V5L are supplied as the voltages to the selected scanning electrodes for only a short time instead of the voltages V0 and V5. On the contrary, as shown in FIG. 4, selective voltages having a larger value of correcting voltage are supplied to the selected scanning electrodes. This is due to the fact that the rounding of the voltage waves on the scanning electrode is larger, because the lighting display element is positioned far from the driving end of the scanning electrode with regard to scanning electrodes Y2 through Y5. Accordingly, the correcting voltages V0U and V5L are supplied for a longer period of time instead of the voltages V0 and V5. Thus, the correcting amount difference between FIG. 3 and FIG. 4 are substantially corrected in accordance with the display position. As described above, by counting the number of lighting display elements on each scanning electrode, and considering with greater weight those lighting display elements positioned greater distance from the driving end of the scanning electrode, a correcting voltage can, thereby, be added and the rounding of display can be reduced by changing the selective voltage supplied to each scanning electrode.

Embodiment 5

In the fourth embodiment a liquid crystal panel 1 is described in which the scanning voltage wave is supplied only from one end portion of the scanning electrode. However, the scanning voltage wave can be supplied from both ends and the result of desired correction can be obtained in a fifth embodiment. In the fifth embodiment, the function $P(|i-S/2|)$ can be substituted for the function q(i) for calculating the value Z'. The function p(x) is a function that decreases when the value of x increases.

Similar results occur when calculating the value of Z' in the fourth and fifth embodiments.

In the fourth embodiment, the method for adjusting the correcting amount, is a method of increasing and decreasing the time period for adding the voltages V0U and V5L as the selective voltage and by forming the voltages V0U and V5L at a level different from selective voltages V0 and V5. This is known as the time access correction. However, other voltage correction methods can be used such as voltage access correction, time voltage access correction and function waveform correction.

In the first, second and third embodiments, the nonselective voltage is varied, while the selective voltage is varied in the fourth and fifth embodiments. Accordingly, the correction method for decreasing unevenness of display in the first and fourth embodiments can be used simultaneously.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A liquid crystal display device, comprising:

a first substrate including a group of scanning electrodes disposed thereon;

a second substrate spaced apart from said first substrate including a group of signal electrodes disposed thereon, a plurality of display elements defined at the intersection of a scanning electrode and a signal electrode which when rendered visible define a pattern to be displayed;

a liquid crystal material disposed in the space between said substrates;

driving circuit means for applying a scanning voltage wave to at least one end of said scanning electrode group and for applying a signal voltage wave to at least one end of said signal electrode group to display the desired output, and for applying a correcting voltage to at least one of said scanning voltage wave and said signal voltage wave in accordance with the desired pattern of display elements to be displayed by the liquid crystal device; and said driving circuit means including varying means for varying the value of said correcting voltage in accordance with at least one of the positions of display elements to be rendered visible relative to the end of said scanning electrode group applied with said scanning voltage waveform and the positions of display elements to be rendered visible relative to the end of said signal electrode applied with said signal voltage wave.

2. The liquid crystal display device of claim 1, wherein the value of said correcting voltage wave is selected for each electrode of at least one of said scanning electrode group and said signal electrode group.

3. The liquid crystal display device of claim 1, wherein said varying means includes time varying means for varying the period of time during which said correcting voltage is applied.

4. The liquid crystal display device of claim 1, wherein said varying means includes means for varying the magnitude of the correcting voltage.

5. The liquid crystal display device of claim 1, wherein said varying means includes means for varying both the magnitude of the correcting voltage and the period of time during which the correcting voltage is applied.

6. The liquid crystal display device of claim 1, wherein said scanning voltage wave includes a selective voltage wave for making display elements along a scanning electrode to which it is applied eligible to be rendered visible when a suitable signal voltage is applied to the signal electrodes defining the display elements and a non-selective voltage wave adapted to make the display elements along the scanning electrode to which it is applied ineligible to be rendered visible, said varying means including counting means for counting the number of display elements defined by signal electrodes having the signal voltage wave applied to the same end thereof to be rendered visible along the next consecutive scanning electrode to receive said selective voltage wave and the number of display elements defined by the same signal electrodes which are rendered visible on the current scanning electrode which is receiving said selective voltage wave; and calculating means for calculating a correction voltage dependent on the difference between said two counts and a function representative of the position of the next consecutive scanning electrode to receive the selective voltage relative to the end of said signal electrodes to which the signal voltage wave is applied.

7. The liquid crystal display device of claim 6, wherein said correcting voltage is applied in place of said non-selective voltage applied to at least one of the other of the scanning electrodes to which the selective voltage is not to be applied.

8. The liquid crystal display device of claim 1, wherein said scanning voltage wave includes a selective voltage wave which renders the display elements along a scanning electrode to which it is applied capable of being rendered visible, and a non-selective voltage wave which when applied to a scanning electrode renders the display elements therealong ineligible to be rendered visible; said varying means including means for detecting the number and position, relative to the end of the scanning electrode to which the scanning voltage wave is applied, of the display elements to be rendered visible; and calculating means for determining the correcting voltage to be applied in place of said selective voltage based on the number of display elements to be rendered visible and a weighing factor which increases with the increased spacing between the display element to be rendered visible and the end of the scanning electrode to which the scanning voltage wave is applied.

9. A method for driving a liquid crystal display having a group of scanning electrodes and a group of signal electrodes, the intersection of each signal electrode and scanning electrode defining a display element capable of being rendered visible to define a desired pattern, comprising:

applying a scanning voltage wave to at least one end of said scanning electrode group and applying a signal voltage wave to at least one end of said signal electrode group to display the desired pattern of display elements;

applying a correcting voltage to at least one of said scanning voltage wave and said signal voltage wave in accordance with the desired pattern of display elements to be displayed; and varying the value of said correcting voltage in accordance with at least one of the positions of display elements to be rendered visible from the end of said scanning electrode group applied with said scanning voltage waveform and the positions of display elements to be rendered visible from the end of said signal electrode applied with said signal voltage wave.

10. The method of claim 9, wherein the correcting voltage is varied by varying the period of time during which the correcting voltage is applied.

11. The method of claim 9, wherein the correcting voltage is varied by varying the magnitude of the correcting voltage.

12. The method of claim 11 wherein both the magnitude of the correcting voltage and the period of time during which the correcting voltage is applied is varied.

13. The method of claim 9, wherein said scanning voltage wave includes a selective voltage wave for making display elements along a scanning electrode to which it is applied eligible to be rendered visible when a suitable signal voltage wave is applied to the signal electrodes defining those display elements, and a non-selective voltage wave adapted to make the display elements along a scanning electrode to which it is applied ineligible to be rendered visible, and including the steps of counting the number of display elements defined by signal electrodes having the signal voltage wave applied to the same end thereof to be rendered visible along the next consecutive scanning electrode to receive said selective voltage wave and the number of display elements defined by the same signal electrodes which are rendered visible on the current scanning electrode which is receiving said selective voltage, and calculating a correction voltage dependent on the difference between said two counts and a function representative of the position of the next consecutive scanning electrode to receive the selective voltage wave relative to the end of said signal electrodes to which the signal voltage wave is applied.

14. The method of claim 13, wherein said correction voltage is applied in place of the non-selective voltage wave applied to at least one of the scanning electrodes which is not to receive the next selective voltage wave.

15. The method of claim 9, wherein said scanning voltage wave includes a selective voltage wave which renders the display elements along a scanning electrode to which it is applied capable of being rendered visible and a non-selective voltage wave which when applied to a scanning electrode renders the display elements therealong ineligible to be rendered visible, and including the steps of detecting the number and position, relative to the end of the scanning electrode to which the scanning voltage wave is applied, of the display elements to be rendered visible; and calculating the correcting voltage to be applied in place of said selective voltage based on the number of display elements to be rendered visible and a weighing factor which increases with the increase spacing between the display element to be rendered visible and the end of the scanning electrode to which the scanning voltage wave is applied.

* * * * *